United States Patent [19]

Higaki

[11] Patent Number: 4,905,055

[45] Date of Patent: Feb. 27, 1990

[54] COPYING MACHINE PROVIDED WITH A PAPER HANDLING DEVICE WITH A PAPER STAPLING FUNCTION

[75] Inventor: Masahiro Higaki, Osaka, Japan

[73] Assignee: Minolta Camera Kabushiki Kaisha, Osaka, Japan

[21] Appl. No.: 299,620

[22] Filed: Jan. 19, 1989

[30] Foreign Application Priority Data

| | | | |
|---|---|---|---|
| Jan. 21, 1988 | [JP] | Japan | 63-12411 |
| Jan. 21, 1988 | [JP] | Japan | 63-12412 |
| Mar. 29, 1988 | [JP] | Japan | 63-76691 |

[51] Int. Cl.[4] ..... G03G 15/00; B42B 2/00

[52] U.S. Cl. ..... 355/324; 270/53; 270/58

[58] Field of Search ..... 355/323, 324, 50, 72; 271/3.1, 265, 287; 270/53, 58

[56] References Cited

U.S. PATENT DOCUMENTS

| | | | |
|---|---|---|---|
| 3,386,729 | 6/1968 | Pine | 270/52.5 |
| 3,645,615 | 2/1972 | Spear | 355/309 |
| 3,697,063 | 1/1972 | Greenfield et al. | 271/4 |
| 3,709,595 | 1/1973 | Turner et al. | 355/324 |
| 3,944,207 | 3/1976 | Bains | 270/58 |
| 4,067,649 | 1/1978 | Hubbard et al. | 355/319 |
| 4,073,391 | 2/1978 | O'Brien | 270/58 X |
| 4,076,408 | 2/1978 | Reid et al. | 355/323 |
| 4,123,155 | 10/1978 | Hubert | 355/319 |
| 4,134,672 | 1/1979 | Burlew et al. | 270/58 X |
| 4,145,037 | 3/1979 | Mol | 270/58 |
| 4,190,246 | 2/1980 | Sasuga | 271/265 |
| 4,203,587 | 5/1980 | Kishi et al. | 271/293 |
| 4,218,128 | 8/1980 | Satomi et al. | 355/319 |
| 4,227,275 | 10/1980 | Söderberg | 271/213 X |
| 4,238,066 | 12/1980 | Brooke | 270/53 X |
| 4,248,413 | 2/1981 | Fox | 270/53 |
| 4,248,525 | 2/1981 | Sterrett | 270/58 X |
| 4,265,440 | 5/1981 | Shibazaki et al. | 271/259 |
| 4,272,180 | 6/1981 | Satomi et al. | 355/309 |
| 4,281,920 | 8/1981 | Cross | 270/53 X |
| 4,295,733 | 10/1981 | Janssen et al. | 355/323 |

(List continued on next page.)

FOREIGN PATENT DOCUMENTS

| | | |
|---|---|---|
| 99250 | 1/1984 | European Pat. Off. . |
| 2732673 | 9/1978 | Fed. Rep. of Germany . |
| 3218747 | 12/1982 | Fed. Rep. of Germany . |
| 3701450 | 7/1987 | Fed. Rep. of Germany . |
| 55-15150 | 2/1980 | Japan . |
| 57-72537 | 5/1982 | Japan . |
| 131667 | 8/1982 | Japan . |
| 59-43765 | 3/1984 | Japan . |
| 59-177232 | 10/1984 | Japan . |
| 60-183461 | 9/1985 | Japan . |
| 60-248563 | 12/1985 | Japan . |
| 61-72569 | 4/1986 | Japan . |
| 26061 | 6/1986 | Japan . |
| 61-145069 | 7/1986 | Japan . |
| 61-261096 | 11/1986 | Japan . |
| 2185465 | 7/1987 | United Kingdom . |

OTHER PUBLICATIONS

IBM Technical Bulletin, vol. 18, No. 9, 2/76.

*Primary Examiner*—L. T. Hix
*Assistant Examiner*—D. Rutledge
*Attorney, Agent, or Firm*—Burns, Doane, Swecker & Mathis

[57] ABSTRACT

A copying apparatus comprising a copying machine; a paper handling device for storing and aligning the papers ejected from the copying machine, for stapling them and for ejecting the bound papers therefrom; and a controller for controlling the paper handling device to eject the papers therefrom when an automatic reset system, which resets the copying mode to the initial mode in the case that the copying machine has not operated for a specified time since the completion of a copying operation, is actuated. Also, in this copying apparatus, the papers left in the paper handling device are ejected therefrom when a specified key is pressed so as to actuate an all reset system to reset the copying mode to the initial mode or when a power switch is operated. Further, the papers left in the paper handling device can be ejected with stapled in response to an operation of the automatic reset system, an operation of the all reset system or operating the power switch.

6 Claims, 19 Drawing Sheets

U.S. PATENT DOCUMENTS

| | | | |
|---|---|---|---|
| 4,313,670 | 2/1982 | Caldwell | 355/324 |
| 4,361,393 | 11/1982 | Noto | 270/58 X |
| 4,365,886 | 12/1982 | Murakami et al. | 355/319 |
| 4,368,972 | 1/1983 | Naramore | 355/324 |
| 4,371,155 | 2/1983 | Asterö et al. | 270/53 |
| 4,376,529 | 3/1983 | George et al. | 270/53 |
| 4,385,827 | 5/1983 | Naramore | 355/323 |
| 4,411,515 | 10/1983 | Kukucka et al. | 270/58 X |
| 4,424,963 | 1/1984 | Bartholet et al. | 355/324 |
| 4,473,425 | 9/1984 | Baughman et al. | 355/324 X |
| 4,497,478 | 2/1985 | Reschenhofer et al. | 270/53 |
| 4,515,458 | 5/1985 | Masuda et al. | 355/323 |
| 4,549,804 | 10/1985 | Braun et al. | 270/53 X |
| 4,564,185 | 1/1986 | Hamlin et al. | 270/53 |
| 4,566,782 | 1/1986 | Britt et al. | 270/53 X |
| 4,573,789 | 3/1986 | Wada | 355/319 |
| 4,582,421 | 4/1986 | Hamlin et al. | 355/324 |
| 4,592,651 | 6/1986 | Oikawa et al. | 355/324 |
| 4,595,187 | 6/1986 | Bober | 270/53 X |
| 4,603,971 | 8/1986 | Kukucka et al. | 270/53 |
| 4,626,156 | 12/1986 | Baughman et al. | 270/58 X |
| 4,647,034 | 3/1987 | Sawa | 271/293 |
| 4,647,188 | 3/1987 | Komiya et al. | 355/55 |
| 4,674,732 | 6/1987 | Hori | 270/53 |
| 4,674,866 | 6/1987 | Tanaka | 355/321 |
| 4,687,191 | 8/1987 | Stemmle | 270/53 |
| 4,702,589 | 10/1987 | Ito | 355/309 |
| 4,718,657 | 1/1988 | Otter et al. | 271/184 |
| 4,721,382 | 1/1988 | Ito et al. | 355/309 |
| 4,730,206 | 3/1988 | Sawada et al. | 355/309 |
| 4,743,945 | 5/1988 | Ito et al. | 355/319 |
| 4,763,889 | 8/1988 | Dei et al. | 355/309 |

COPYING MACHINE PROVIDED WITH A PAPER HANDLING DEVICE WITH A PAPER STAPLING FUNCTION

FIELD OF THE INVENTION

The present invention relates to a copying apparatus comprising a copying machine and a paper handling device for storing and aligning papers ejected from the copying machine and for stapling the papers.

BACKGROUND OF THE INVENTION

Copying machines provided with such paper handling devices as mentioned above are disclosed in Japanese Patent Laid Open Publications No. 59-43765, No. 60-183461 and No. 60-248563. This type of paper handling device provided for copying machines is usually called a finisher and is constructed so that copied papers are stored and aligned in a tray and transported to a stack unit to be stacked after being stapled. Regarding the tray of the finisher, the type of tray which enables the papers to be substantially vertically stored therein for saving space and for the convenience of sheet alignment has been developed.

In a stapling operation with the use of said finisher, a manual stapling, which is a mode enabling an operator to staple freely by pressing a stapling key, can be selected. During an operation in the manual stapling mode, if an operator leaves the place in the middle of the stapling process or if an operator forgets to press the stapling key to execute a stapling operation although the papers are stored and aligned in a stapling tray, the papers will be left in the stapling tray. After that, if another operator executes an stapling operation, a trouble will occur such as mixing the papers currently to be stapled with the papers left therein by the last operator and stapling all together. Also, such a trouble is apt to occur when the papers stored in the stapling tray can not be recognized or hard to be recognized from outside. Further, when a power switch is turned off while keeping the papers in the stapling tray without being stapled, the papers may be forgotten to be ejected from the stapling tray. When another operator turns on the power switch again and proceeds to the stapling operation, a trouble that the papers currently to be stapled are mixed and stapled together with the papers left behind by the last operator may occur.

SUMMARY OF THE INVENTION

In view of the above-mentioned problems, an object of the present invention is to provide a copying apparatus which does not involve a risk that the papers left in a paper handling device are stapled by mistake together with the copies made by the next operator.

To attain the above object, a copying apparatus according to the present invention comprises a copying machine and a paper handling device for storing and aligning a predetermined number of papers ejected from the copying machine, for stapling the papers and for ejecting the bound papers therefrom, and the papers left in the paper handling device are ejected in response to an operation of automatic reset means, which resets the copying mode to the initial mode when the copying machine has not been operated for a specified time since the completion of a copying operation.

Also, a copying apparatus according to the present invention, when all reset means is actuated to reset the copying mode to the initial mode by pressing a specified key, the papers left in a paper handling device are ejected.

Further, a copying apparats according to the present invention, the papers left in a paper handling device are ejected when its power switch is operated.

With the copying apparatuses as described above, the papers left in the paper handling device are automatically ejected therefrom, and this can prevent a trouble that the papers left behind are stapled together with the copies made by the next operator.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE PREFERRED EMBODIMENTS

Figure 1:
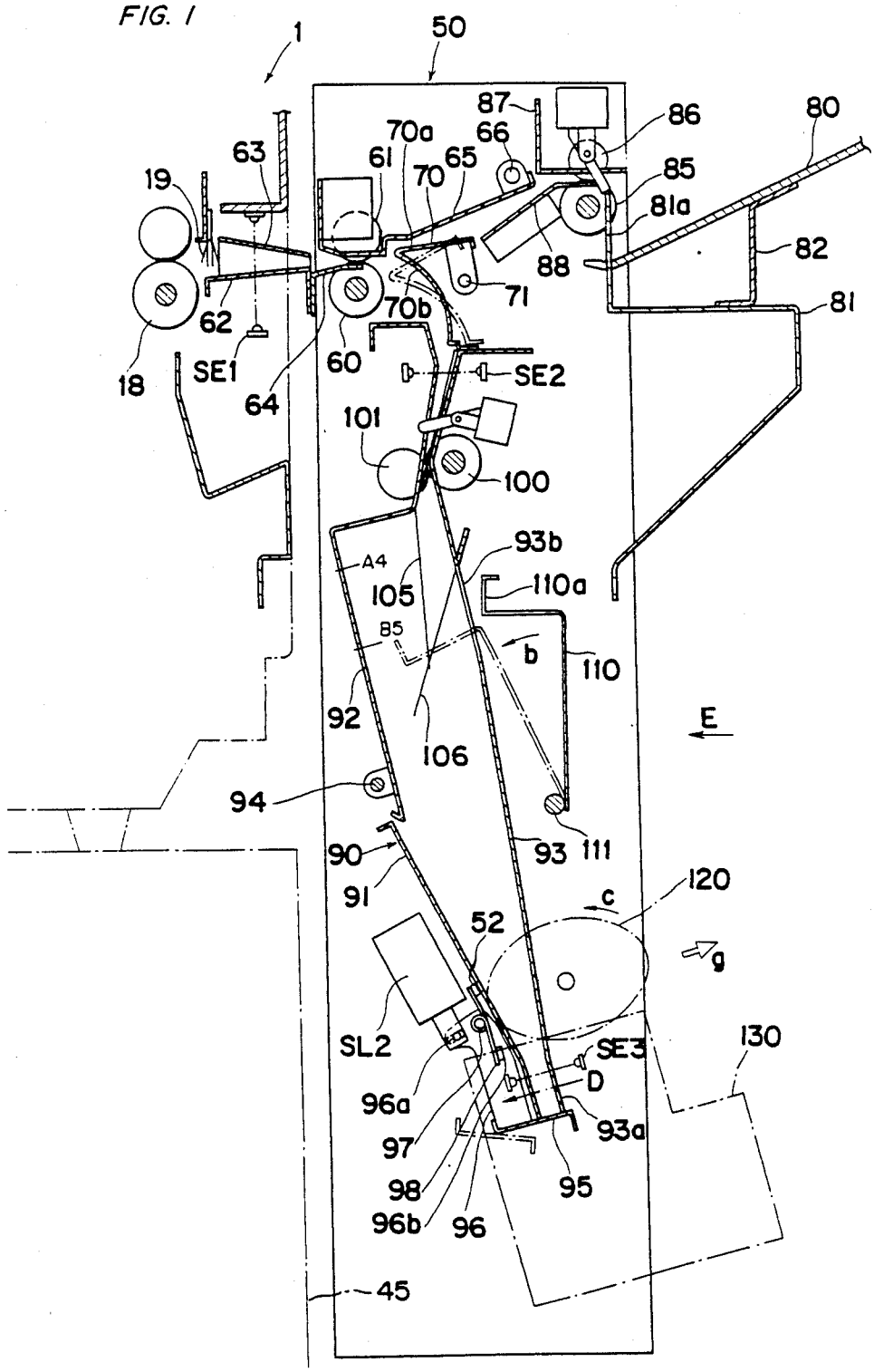
FIG. 1 is an internal composition of a finisher unit.

Before the description of the present invention proceeds, it is to be noted that like parts are designated by like reference numerals throughout the accompanying drawings.

[First Embodiment]

The embodiment of a copying apparatus according to the invention is described below by referring to the accompanying drawings.

(General constitution including the copying machine and the ADF)

Figure 7:
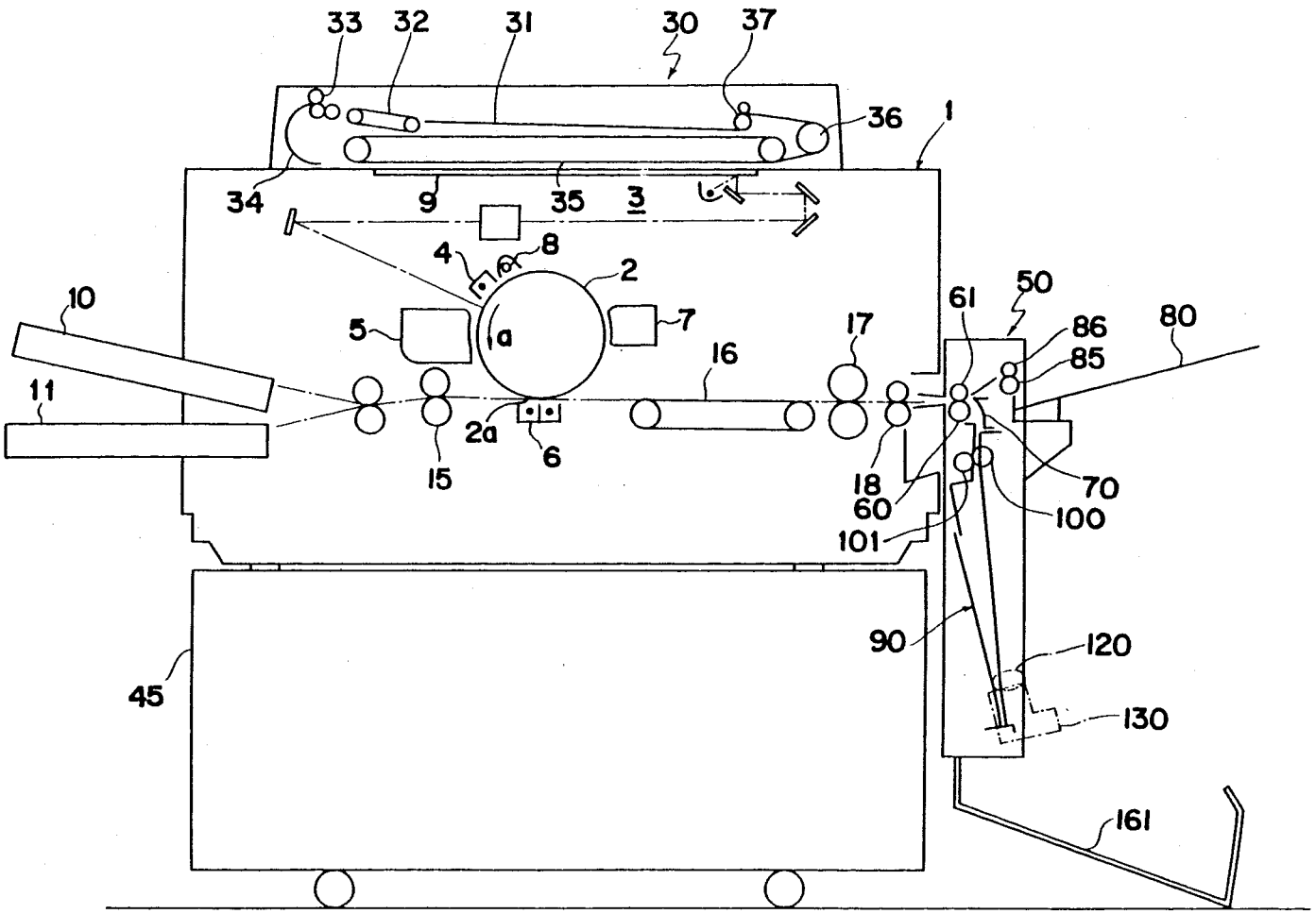
FIG. 7 is a schematic block diagram showing a copying machine and the finisher unit.

First, the general constitution of a copying machine 1 is described referring to FIG. 7.

The copying machine 1 is placed on a desk 45, and an automatic document feeder 30 with a document circulating function, which is hereinafter referred to as ADF is disposed on the top surface thereof. Inside the copying machine 1, there is a photosensitive drum 2 rotatable in the arrow (a) direction. Around the drum 2, such well known image forming elements are arranged as an optical system 3, an electrifying charger 4, a developing device 5, a transfer charger 6, a cleaning device 7, an eraser lamp 8 and others. These elements and the copying processes of the elements are so well known that the detailed description of them is omitted.

Copying papers which are loaded in automatic paper feeder cassettes 10 and 11 are fed one by one from a specific cassette selected from the cassettes 10 and 11. Then, by a pair of timing rollers 15, a copying paper is synchronized with a toner image formed on the circumferential surface of the photosensitive drum 2 and is transported to a transfer portion 2*a*. After the transfer processing, the copying paper is supplied to a fixing device 17, where toner image is fixed, by a conveyer belt 16, and then the paper is ejected by a pair of ejection rollers 18.

The ADF 30 generally comprises a document deck tray 31, a document feeder belt 32, a pair of document feeder rollers 33, a diverting guide plate 34, a transport belt 35, a diverting roller 36 and a pair of ejection rollers 37. The ADF 30 transports one set of documents sheet by sheet starting with the last page. One set of documents is placed on the tray 31 with the reverse side of the last page positioned downward and drawn out sheet by sheet from the last page by the travel of the feeder belt 32. Then, the document is fed between the transport belt 35 and a document deck glass 9 via the pair of document feeder rollers 33 as well as the diverting guide plate 34. Next, the document is set at a specified position on the document deck glass 9 by the travel of the transport belt 35 to be subjected to an optical scanning of the optical system 3. After the image exposure, the document is transported by the transport belt 35 from the document deck glass 9 toward the right side in FIG. 7, where the document is diverted by the diverting roller 36, and then ejected by the pair of ejection rollers 37 onto the stack of the other documents placed on the tray 31 with the surface having an image upward.

Incidentally, one sequence of each image exposure for each document is defined as one cycle of copying operation.

Figure 8:
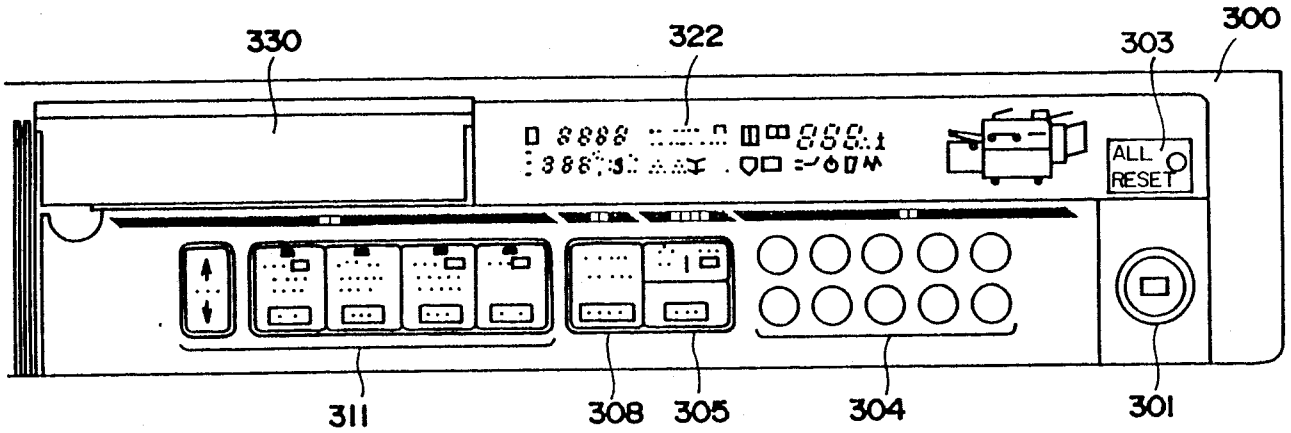
FIG. 8 is a plan view showing an control panel of the copying machine.

The ADF 30 repeats one cycle of copying operation up to the number of cycles which has been inputted with ten numerical keys 304 shown in FIG. 8. Additionally, the number of documents to be subjected to one cycle of copying operation is also inputted with the numerical keys 304. Further, the ADF 30 is disposed to be freely lifted from and lowered onto the copying machine 1. Therefore, with the ADF 30 in the lifted position, a document can be manually set on the document deck glass 9 for a copying operation. The ADF 30 does not operate when lifted. Lifting the ADF 30 is detected by a switch not shown in the drawings which is located in the vicinity of the document deck glass 9.

With a paper handling device in this embodiment of the invention, copying papers ejected from the copying machine 1 are selectively received either by an ejection tray 80 or by a stapling tray 90 where the papers are aligned and then stapled with a stapler 130. Accordingly, when a plurality of sets of copying papers are to be duplicated with the use of the ADF 30 and are to be proceeded to the stapling operation, copying papers of one set are sequentially stored on the stapling tray 90. Then, when one cycle of copying operation has completed, the stapler 130 is actuated based on a stapling signal outputted from the copying machine 1 in order to staple one set of copying papers. The one set of copying papers stapled is stacked in a stack box 161. The same procedure is repeated for each set of copying papers.

(Control panel of the copying machine)

Now, a control panel 300 of the copying machine 1 will be explained with reference to FIG. 8. The control panel 300 is disposed in the upper front portion of the copying machine 1 and has a print key 301 for initiating a copying operation, a ten-key 304 for setting the necessary number of copy sets, the number of originals to be copied, the magnification and so on, an exposure setting key 305 for setting copy image density, a selector key 308 for switching paper feed from the upper cassette 10 or lower cassette 11, and magnification setting keys 311 for setting copy magnification. Special input keys, such as a magnification operation key, a zoom memory setting key, a zoom memory key and a book copying key are covered with an open/close cover 330, and they are operable only when the open/close cover 330 is opened. Numeral 322 shown in FIG. 8 represents a display panel for indicating the required number of copy sets, the magnification, the paper size and so on.

(Constitution of the finisher unit)

The constitution of a finisher unit 50 is hereinafter described by referring to FIG. 1 through FIG. 6.

The finisher unit 50 generally comprises rollers 60 and 61 for receiving a copying paper, a diverting member 70 for diverting a transport course, a paper ejection tray 80, paper ejection rollers 85 and 86 for ejecting a copying paper onto the ejection tray 80, a stapling tray 90, paper transport rollers 100 and 101 for transporting a copying paper to the stapling tray 90, a pressing member 110 capable of pressing the upper portion of papers stored in the stapling tray 90, a paddle wheel 120 for aligning a copying paper stored in the stapling tray 90 in relation to a corner portion (A) and a stapler 130.

A portion to receive a copying paper ejected from the copying machine 1 comprises, in addition to the above mentioned rollers 60 and 61, guide plates 62 and 63 laterally opposing to the pair of ejection rollers 18 and a guide plate 64 provided within the finisher unit 50. A guide plate 65 extends from the receiving portion to the ejection rollers 85 and 86. The guide plate 65 can be lifted upward on a pivot 66 so as to enable various procedures such as the removable of jammed papers. The roller 61 is mounted on the guide plate 65.

Incidentally, an ejection portion of the copying machine 1 has a neutralizing brush 19 and a photosensor SE1 which detects a copying paper.

As shown in FIG. 1, the bill-shaped diverting member 70 is pivotally attached to a pivot 71, and with a solenoid not shown in the drawings turned on, the diverting member 70 shifts its position from that shown by the dashed line to that shown by the solid line. At the position of the dashed line, the diverting member 70 leads a copying paper to the paper ejection tray 80 along the top surface 70*a* of the member 70. At the position of the solid line, the diverting member 70 leads a copying paper to the stapling tray 90 along the inward curved surface 70*b*.

The paper ejection tray 80 is secured on the exterior of the finisher unit 50 through support plates 81 and 82. The bottom end of the paper ejection tray 80 is located below the ejection rollers 85 and 86 and intersects with a stopper 81*a* to stop the trailing edge of copying paper. Near the ejection rollers 85 and 86, guide plates 87 and 88 are disposed, and the ejection roller 86 is attached to the guide plate 87.

The stapling tray 90 comprises a main base plate 91, a guide plate 92, a guide plate 93 facing both the main base plate 91 and the guide plate 92 and a stopper 95. The stapling tray 90 is disposed upright, slightly leaning toward the left. The upper portion of the guide plate 92 extends toward the vicinity of the inwardly curved surface 70*b* of the diverting member 70 and can be pivotally opened up counterclockwise on a pivot 94 in FIG. 1 so as to allow procedures such as the removable of jammed paper. The upper portion of the guide plate 93 opposes the upper portion of the guide plate 92 with a narrow space and extends toward directly below the diverting member 70. An area 93*a*, the lower portion of the guide plate 93 faces the base plate 91 at the position lower than that of a paddle wheel 120 described later, with the narrower space than those in the other areas. More specifically, the space between the area 93*a* and the base plate 91 is slightly larger than the thickness of a specified number of copying papers which can be stored in the stapling tray 90. The reason why the space in an area near the paddle wheel 120 is narrower and the spaces in the other areas are larger is that it is intended to minimize the friction exerted between the already stored and aligned copying papers and the currently aligned paper in order to ensure the alignment of all the copying papers in reference to lines (A').

Additionally, the above mentioned area is provided with a photosensor SE3 for detecting a copying paper transported into the stapling tray 90.

The stopper 95 forms the bottom plate of the stapling tray 90 and is rotatably attached to a pivot 97 through an arm 96. The arm 96 is connected with a solenoid SL2 with a pin 96*a*, and thereby both ends of a torsion spring 98 coiled around the pivot 97 is engaged respectively with a projection 96*b* on the arm 96 and a projection 52 on the frame 51. Therefore, as shown in FIG. 1, when the solenoid SL2 is in the off status, the stopper 95 is in a position shown by the solid line in FIG. 1 with the elasticity of the spring 98 and closes the bottom of the stapling tray 90. On the other hand, once the solenoid SL2 is turned on, the stopper 95 pivotally moves on the pivot 97 to a position shown by the dashed line to open the bottom of the stapling tray 90.

The transport rollers 100 and 101 are disposed at the area where the space between the upper portions of the guide plates 92 and 93 is the narrowest. The transport rollers 100 and 101 transport a copying paper guided downward along the inward curved side 70*b* of the diverting member 70. A photosensor SE2 for detecting a copying paper is disposed immediately above the rollers 100 and 101.

Strip-shaped flexible sheets 105 are attached to the upper portion of the plate 92. The flexible sheets 105 hang down in the stapling tray 90 through the side of the nip portion between the rollers 100 and 101. The bottom end of the flexible sheets 105 extends to the position slightly lower than that of the upper edge of a minimum size B5 paper to be stored in the stapling tray 90, and it also reaches a neutralizing brush 106 attached to the guide plate 93. While a copying paper is transported to the stapling tray 90, the flexible sheets 105 function to provide the copying paper with a stiffness proportional to the thickness of the paper in order to ensure the paper to be correctly transported into the stapling tray 90. Further, the sheets 105 make contact with the neutralizing brush 106 and support the upper portion of the stored copying papers in order to prevent the copying paper from leaning toward the guide plate 93 or collapsing.

Additionally, the nip portion between the transport rollers 100 and 101 is arranged so that a copying paper nipped may face the guide plate 93. This arrangement is provided in order to reduce the contact friction between a copying paper being transported into the stapling tray 90 and copying papers already stored in the tray 90.

Figure 3:
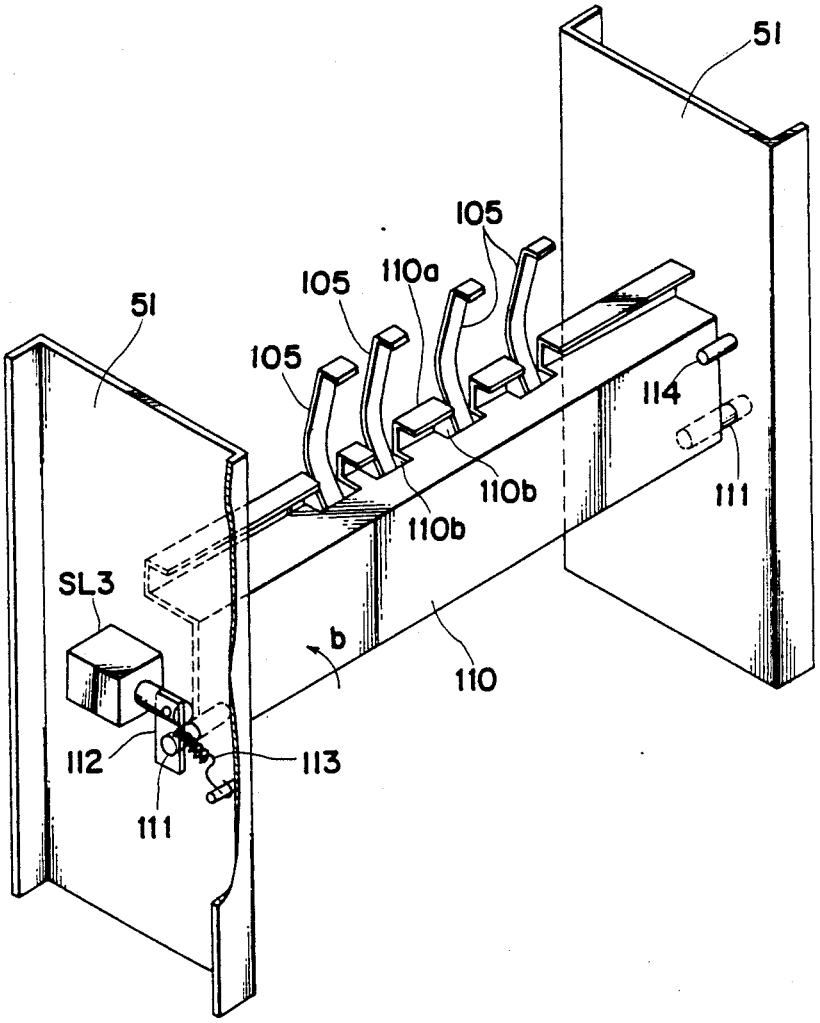
FIG. 3 is a perspective view of pressing members.

As shown in FIG. 3, the pressing member 110 is secured to two pivots 111 which are rotatably attached to frames 51. One of the pivots 111 is connected to a solenoid SL3 via an arm 112, and the arm 112 is drawn by a coil spring 113 in the direction reverse to the arrow (b). Therefore, when the solenoid SL3 is in the off status, the pressing member 110 is attracted by the drawing force of the coil spring 113 in the direction reverse to the arrow (b) and keeps outside of the guide plate 93 as shown by the solid line in FIG. 1 until a sheet comes into the stapling tray 90. On the other hand, when the solenoid SL3 is turned on, the pressing member 110 pivotally rotates on the pivots 111 in the direction of the arrow (b), and a head 110*a* of the pressing member 110 is protruded through an opening 93*b* on the guide plate 93 into the stapling tray 90 in order to press the upper portion of copying papers stored in the stapling tray 90. Additionally, the head 110*a* is provided with notches 110*b* so as to prevent interference with the above mentioned flexible sheets 105 and neutralizing brush 106.

Figure 2:
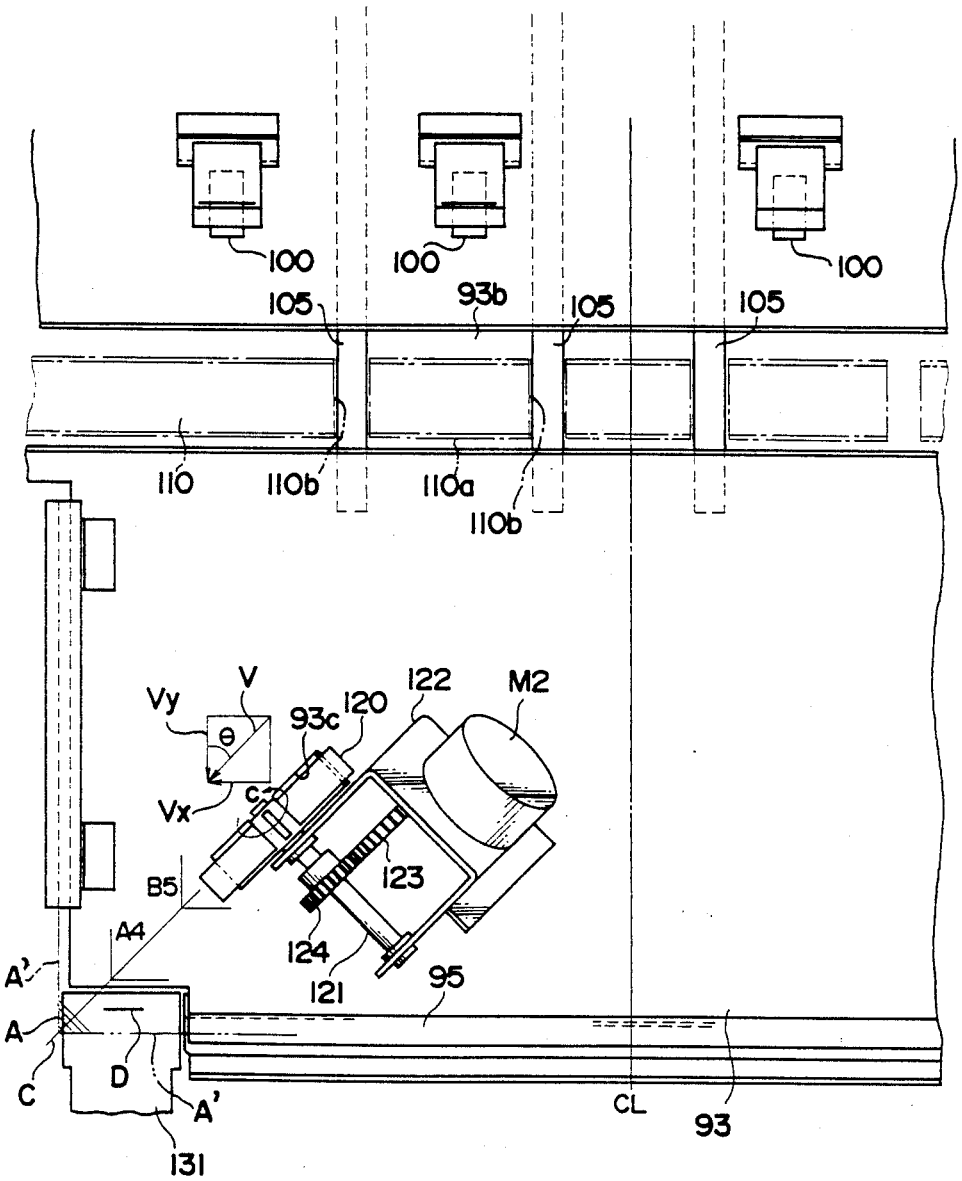
FIG. 2 is an elevational view taken in the direction of the arrow E in FIG. 1.

In FIG. 2, the paddle wheel 120 whose top is equipped with a plurality of radially-arranged flexible blades (rubber plates) is disposed at an angle of $\theta$ to the transporting direction on the surface for a copying paper. An axle 121 of the paddle wheel 120 is rotatably attached to a bracket 122 arranged to the exterior of the guide plate 93. A part of the paddle wheel 120 protrudes through a long hole 93*c* formed on the guide plate 93 into the stapling tray 90. A reversible motor M2 mounted on the bracket 122 is connected with a gear 123 through a reducing mechanism not shown in the drawings. The gear 123 meshes with another gear 124 fixed to the axle 121, and therefore the paddle wheel 120 is rotatable in forward and reverse directions.

More specifically, the paddle wheel 120 rotating in the direction of the arrow (c) shifts a copying paper, which has been transported into the stapling tray 90, toward the corner portion (A) where the reference lines (A') intersect with each other. In this case, the peripheral velocity (V) of the paddle wheel 120 is predetermined so that the vertical component (Vy) is larger than the peripheral velocity of the transport roller 100. However, the transporting force of the paddle wheel 120 is predetermined so as to be weaker than that of the transport rollers 100 and 101. Therefore, the transporting force of the paddle wheel 120 exerted on a copying paper and derived from the rotation int he direction of the arrow (c) works after the trailing edge of the copying paper has passed the nip portion between the rollers 100 and 101. The position of the copying paper which has passed the rollers 100 and 101 is indicated by A4 or B5 in FIG. 2. Additionally, the copying papers are transported based on the center line (CL) as a reference line.

The inclination $\theta$ of the paddle wheel 120, which indicates the direction in which the transporting force of the paddle wheel 120 works , is predetermined so as to be substantially parallel with a straight line connecting the corner of a copying paper with the corner portion (A) in FIG. 2 when the transporting force of the paddle wheel 120 starts exerting on the paper after the trailing edge of a copying paper has passed the transport rollers 100 and 101. This arrangement allows a copying paper to move directly to the alignment corner (A) by the rotation of the paddle wheel 120 via the shortest distance. Therefore, the alignment corner (A) should preferably be on a line (C) extending from the above corner of a copying paper and meeting the vertical line at an angle $\theta$. However, when the angle $\theta$ is smaller than 45 degrees, the corner (A) may be located below the extending line (C). When the angle $\theta$ is more than 45 degrees, the corner (A) may be above the line (C).

Additionally, the positional relation in the vertical direction between the paddle wheel 120 and the pair of transport rollers 100 and 101 must be arranged so that a copying paper is always subjected to the transporting force of either the paddle wheel 120 or the pair of transport rollers 100 and 101.

The stapler 130 is a well-known electric type, wherein as shown in FIG. 2 a receiver 131 is disposed on the plane common to the base plate 91 of the stapling tray 90 to staple one set of copying papers stored and aligned in the stapling tray 90.

(Operation of the finisher unit)

The operation of the finisher unit 50 is described, below.

(Non-stapling mode)

The non-stapling mode is an operation mode to stack and store copying papers which have been ejected from the pair of ejection rollers 18 on the copying machine 1 onto the paper ejection tray 80 without a stapling operation.

In this mode, the diverting member 70 is at the position shown by the dashed line in FIG. 1, thereby a copying paper received by the rollers 60 and 61 is guided both by the top side 70*a* of the diverting member 70 and by the guide plate 65 and then is ejected by the paper ejection rollers 85 and 86 onto the paper ejection tray 80.

(Stapling mode)

Figure 6:
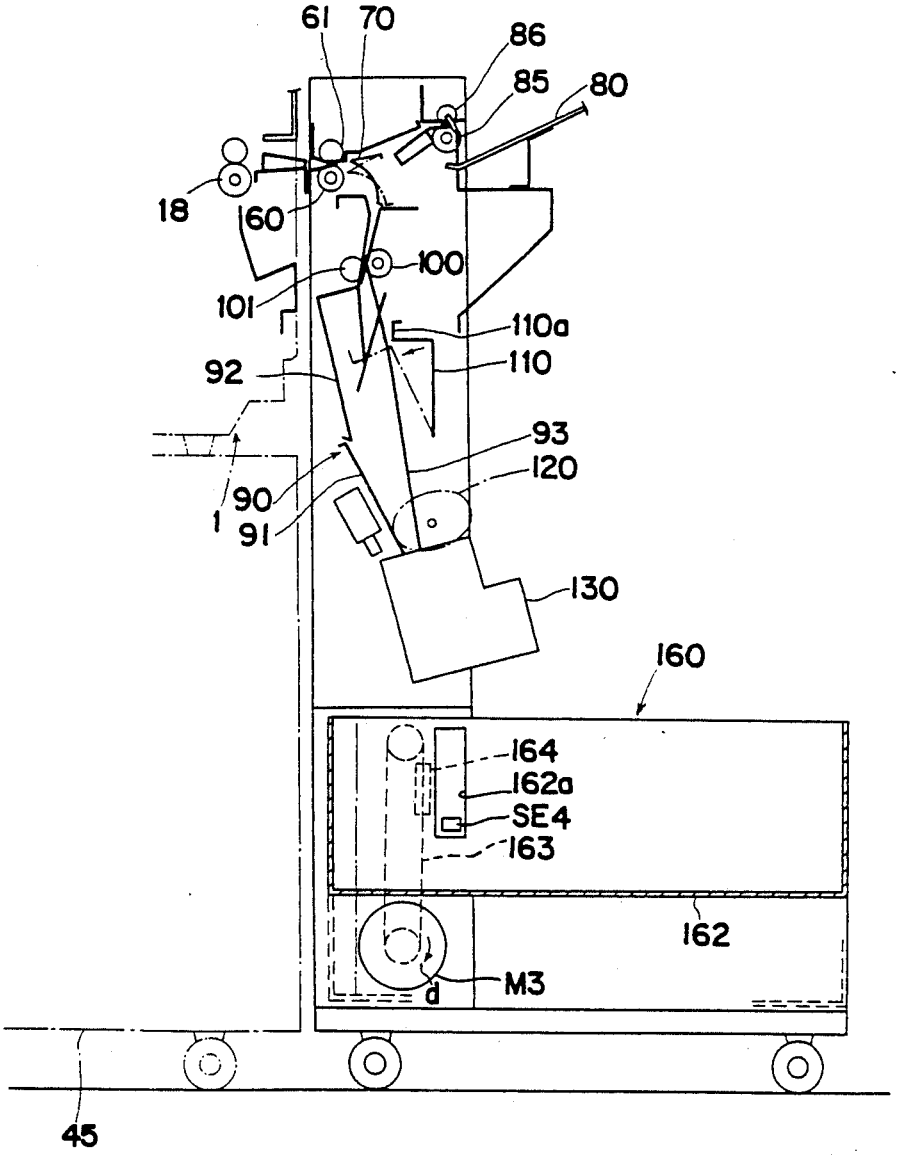
FIG. 6 is a schematic block diagram showing the finisher unit with a stack unit.

The stapling mode is an operation mode where copying papers are stored and aligned in the stapling tray 90 and are stapled with the stapler 130, and then the stapled sets are stacked in a stack box 161 (see FIG. 7) or in a stack unit 160 (see FIG. 6).

In this mode, the diverting member 70 is shifted to the position shown by the solid line in FIG. 1, thereby a copying paper introduced by the rollers 60 and 61 is guided both by the inward curved side 70*b* of the diverting member 70 and by the upper portions of the guide plates 92 nd 93, and it is transported by the rollers 100 and 101 into the stapling tray 90. Synchronously with the rotation of the transport rollers 100 and 101, the paddle wheel 120 is actuated to rotate forward in the direction of the arrow (c), thereby the copying paper whose trailing edge has left the rollers 100 and 101 receives the transporting force by the rotation of the paddle wheel 120 and moves toward the corner portion (A) to be aligned. During this course, the copying paper receives the transporting force at the nip portion so as to face the guide plate 93 based on the predetermined direction of the nip portion. At the same time, the copying paper is provided with stiffness proportional to the thickness as the flexible sheets 105 rubs the paper to minimize the friction with already stored copying papers, and consequently the copying papers are stored in the stapling tray 90 one by one. Simultaneously, the copying paper touches the neutralizing brush 106 and is electrically neutralized. Additionally, the tips of the flexible sheets 105 and neutralizing brush 106 touch the upper portion of copying papers already stored in the stapling tray 90 in order to prevent the papers from leaning or collapsing.

Incidentally, when a copying paper is stored as it has been curled due to the heating of the fixing device 17 and if the upper portion of the paper is warped toward the guide plate 93, the next paper being transported interferes with the upper portion of the curled paper already stored, thereby causing paper jamming. In order to prevent this trouble, the first embodiment provide an arrangement wherein the pressing member 110 presses the upper portion of the already stored copying papers.

Figure 4:
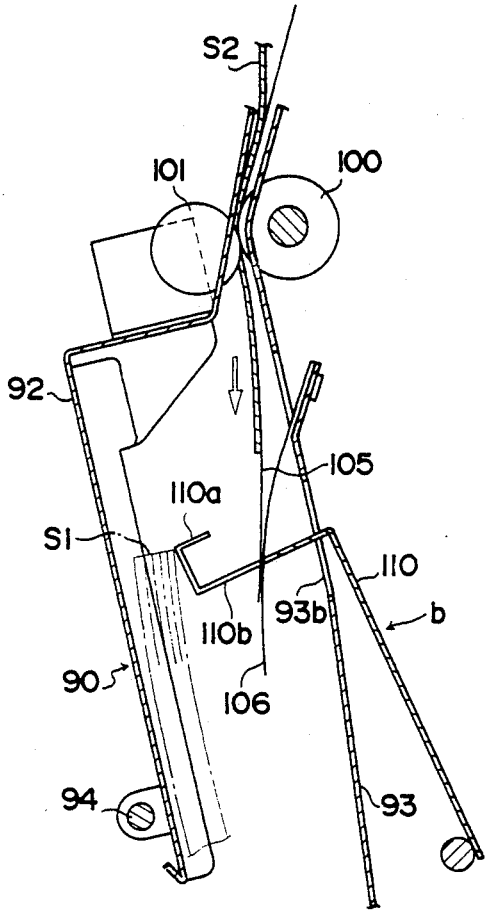
FIG. 4 and FIG. 5 are explanatory drawings showing paper transporting into a stapling tray.

More specifically, when a specified period has elapsed since the leading edge of a copying paper is detected by the photosensor SE2, for example, when the paper is aligned in the corner portion (A) by the rotation of the paddle wheel 120, the solenoid SL3 is turned on, and thereby the pressing member 110 pivotally moves on the pivot 111 in the direction of the arrow (b), and the top portion 110 protrudes into the stapling tray 90 through the opening 93*b* on the guide plate 93 so as to press the upper portion of the papers S1 already stored (see FIG. 4). Consequently, the upper portion of the curled papers S1 is pressed toward the bottom of the stapling tray 90, that is, toward the guide plate 92 in order to correct the curl of the papers S1.

Further, since the solenoid SL3 is turned off at least immediately before the leading edge of the next paper S2 reaches the vicinity of the pressing member 110, the pressing member 110 pivotally moves in the direction reverse to the arrow (b) so as to cancel the pressing force on the stored papers S1.

The above mentioned operation corrects the curled upper portion of the copying papers S1 already stored in the stapling tray 90 which faces the guide plate 93, and it successfully prevents paper jamming which may be caused by the interference between the copying paper S2 coming into the stapling tray 90 and the already stored papers S1.

Figure 5:
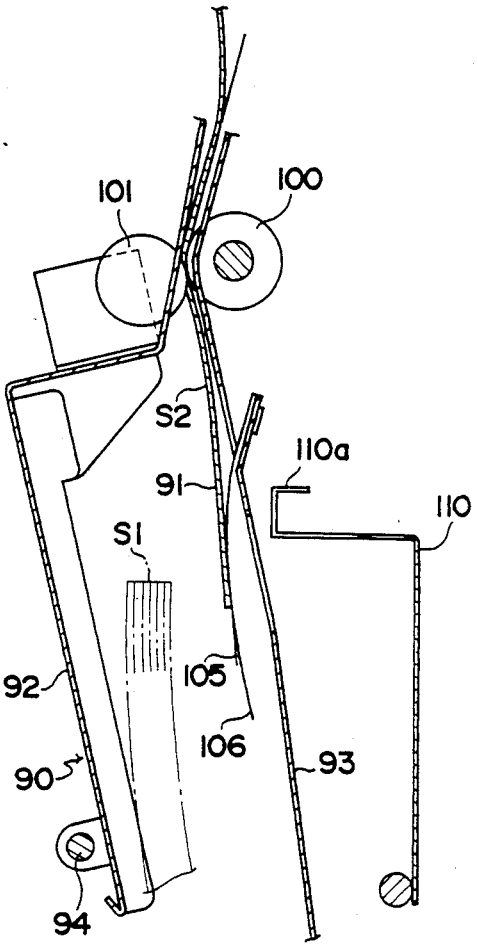

Additionally, as in the embodiment according to the present invention, if the pressing member 110 intersects the flexible sheets 105 at the notches 110*b*, the next copying paper is more smoothly guided into the stapling tray 90 by use of notches 110*b*. More specifically, when the pressing member 110 presses the copying papers stored in the tray 90, it moves toward the tray 90 intersecting the flexible sheets 105 at the notches 110*b*. Thereby, as shown in FIG. 4, the flexible sheets 105 are not forced to the left with the movement of the pressing member 110. Then, when the pressing member 110 is lifted off the stapling tray 90, as shown in FIG. 5, there is enough space between the stored copying papers S1 and the flexible sheets 105 for the next sheet S2 to come into smoothly, and this prevents such troubles as interference between the paper coming into the tray 90 and the copying papers stored there and so on.

The above operation enables copying papers to be stored and correctly aligned in the stapling tray 90 sheet by sheet in the order of page with the copied side of each paper facing to the guide plate 93. When the previously mentioned ADF 30 with a document circulating function is used, the stapler 130 is actuated based on a stapling signal outputted at the timing synchronized with the completion of one cycle of copying operation to staple the copying papers at the stapling position (D). When the ADF 30 is not used, the stapler 130 is actuated to do the same based on a stapling signal inputted by an operator.

Once the stapling operation has completed, the solenoid SL2 is turned on, and the stopper 95 retreats to a position indicated by the dashed line shown in FIG. 1 so as to open the bottom of the stapling tray 90. Therefore, the stapled one set of papers is discharged downward from the stapling tray 90 by its own weight. At the same time, the motor 120 is switched to reverse operation, and the paddle wheel 120 rotates in the direction reverse to the arrow (c). Then, the stapled set of papers is ejected downward from the stapling tray 90 by its own weight as well the actuating force generated by the rotation of the paddle wheel 120, turning to the right and downward in FIG. 2.

More specifically, the stapled set of papers turns to the right by the actuating force due to the reverse rotation of the paddle wheel 120, thereby the stapled set is ejected while the stapled portion at first leaves the stapling position (D).

As described above, one set of copying papers ejected from the stapling tray 90 is stacked in the stack box 161 shown in FIG. 6. When one set of the copying papers is discharged from the stapling tray 90, the operations of the ADF 30 and the copying machine 1 restart to execute the next copying operation. Such a sequence of operations, including one cycle of copying operation and an operation of stapling papers prepared in the one cycle of copying operation, are repeated up to the number of sequences inputted with the ten numerical keys 304.

(Constitution and operation of the stack unit)

The stack unit 160 is described below in reference to FIG. 6.

The stack unit 160 is arranged so that the stack box 162 is connected through a fixture 164 to a belt 163 which is actuated by a motor M3 to rotate in the forward and reverse directions, in order to allow the upward or downward adjustment of the unit 160. Additionally, a photosensor SE4 for detecting the set of copying papers is aligned to openings 162*a* provided on both sides of the stack box 162 to detect the height of sets of copying papers stacked in the stack box 162.

More specifically, when each set of copying papers having been stapled is discharged from the stapling tray 90 and sequentially stacked in the stack box 162, and if the sensor SE4 detects the top of copying papers, the motor M3 is actuated to rotate in the direction of the arrow (d) and the stack box 162 moves downward in accordance with the rotation of the belt 163. As the stack box 162 moves downward, the top of copying papers is unlocked from the optical axis of the sensor SE4 and turns off the sensor SE4, that is, turns off the motor M3. Therefore, every set of copying papers is without fail discharged and stacked at a constant height.

(Control panel of the finisher unit)

Figure 9:
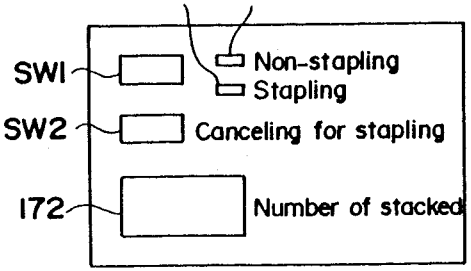
FIG. 9 is a plan view showing an control panel of the finisher unit.

A control panel of the finisher unit 50 is described below in reference to FIG. 9.

SW1 is a mode select switch, and numeral 170 represents a non-stapling mode indicator LED, and numeral 171 represents a stapling mode indicator LED. In the starting stage, the non-stapling mode is started as a default mode. Every time the select switch SW1 is pressed, the stapling mode and the non-stapling mode are alternately designated, thereby the indicator LED 170 or 171 correspondingly lights up.

When using the previously mentioned ADF 30 to execute the stapling mode, the timing or the like of the stapling operation is automatically designated by communication between the ADF 30 and a controller on the copying machine 1 as described below. In contrast, when the ADF 30 is not used to execute the stapling mode, the select switch SW1 is first pressed to designate the stapling mode, and then after the completion of a predetermined number of copying operation, the select switch SW1 is pressed again to execute the stapling operation.

SW2 is a stapling mode canceling switch which cancels the stapling mode when pressed during the stapling mode with the ADF 30. For example, in case that the operator decides to make eight sets of copying papers stapled and remain two other sets of copying papers unstapled while making ten sets of copying papers, the operator can press the canceling switch SW2 during the processing of the eighth set of copying papers to eject the papers of the ninth and tenth sets to the ejection tray 80 without stapling.

Numeral 172 represents an indicator for indicating the number of stacked sets, that is, the number of stapled sets of copying papers. The numerical indication of the indicator 172 is incremented based on a signal from the controller on the copying machine 1, and the indicator 172 is reset based on a clear signal or the like from the controller.

(Control circuit)

Figure 10:
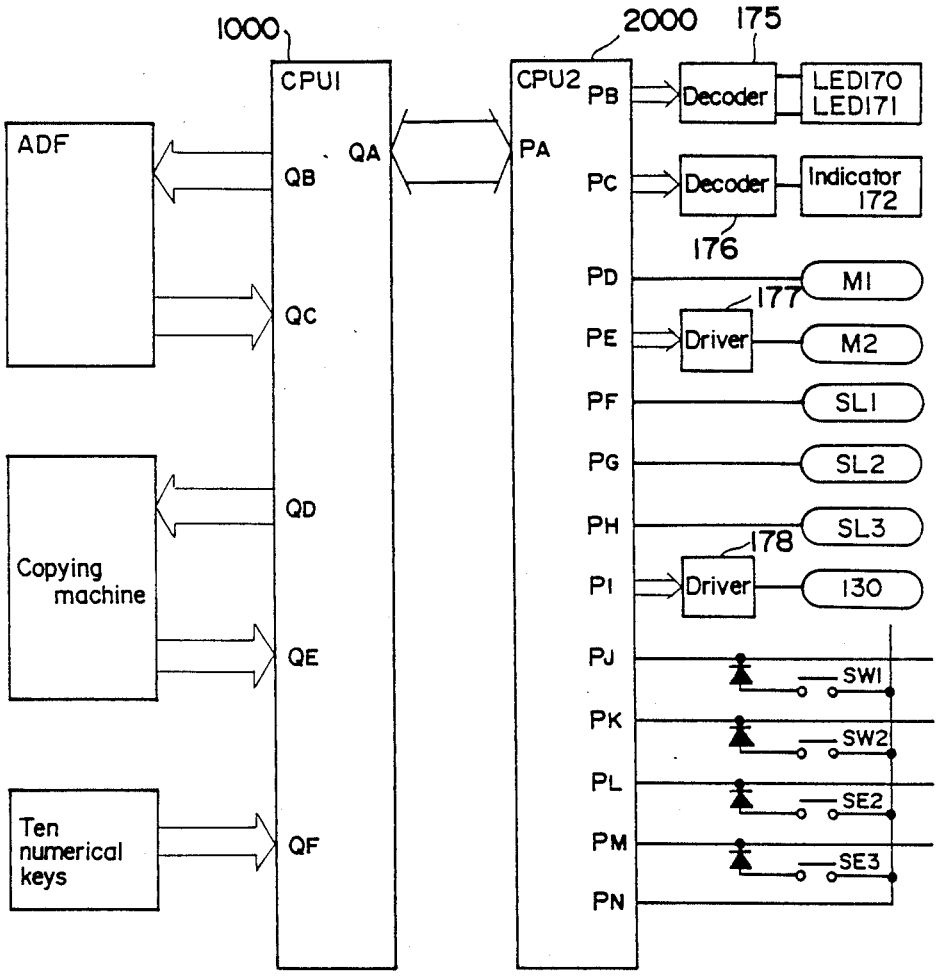
FIG. 10 is a diagram showing a control circuit.

FIG. 10 illustrates a control circuit on the copying apparatus. The first CPU 1000 controls the operations of the ADF 30 and the copying machine 1. With the first CPU 1000, signals for controlling various movable elements on the ADF 30 are outputted from a port QB, and signals indicating the status of the ADF 30 are inputted to a port QC. Signals for controlling various movable elements on the copying machine 1 are outputted from a port QD and signals indicating the status of the copying machine 1 are inputted to a port QE. Numeric data or the like from the ten numeral keys 304 and each key on the control panel are inputted to a port QF.

The second CPU 2000 controls the operation of the finisher unit 50. With the second CPU 2000, the indicator LEDs 170 and 171 are connected to a port PB via a decoder 175, and the indicator 172 of the number of stacked sets of copying papers is connected to a port PC via a decoder 176. The motor M1 for driving the rollers 60, 85 and 100 is connected to a port PD, and the motor M2 for driving the paddle wheel 120 is connected to a port PE via a reversible driver 177. A port PF is connected to the solenoid SL1 for driving the diverting member 70; a port PG is connected to the solenoid SL2 for driving the stopper 95; a port PH is connected to the solenoids SL3 for driving the pressing member 110. The stapler 130 is connected to a port PI via a driver 178. Additionally, to ports PJ through PN, the switches SW1 and SW2 and the sensors SE2 and SE3 are correspondingly connected.

Further, the first CPU 1000 and the second CPU 2000 exchange an ADF signal, a stapling signal, a copy signal, an ejection signal, a copy wait signal, an automatic reset signal, an all reset signal, a power-on signal, a power-off signal and so on via the ports QA and PA. The automatic reset signal is the one which is outputted from the first CPU 1000 in response to an automatic resetsystem for resetting the copying mode to the initial mode when the copying machine 1 has not been operated for a specified time since the completion of a copying operation. The all reset signal is outputted from the first CPU 1000 when an all reset system for resetting the copying mode to the initial state is actuated by pressing a specified key, for example, an all reset key 303. The power-on signal and the power-off signal are correspondingly outputted from the first CPU 1000 when the power switch of the copying machine 1 is turned on and off.

Additionally, turning off the power switch does not turn off the current from an outlet to the copying machine 1, but it stops the operation of each key in the copying machine 1. Therefore, the operations of the CPU 1000 and so on are not stopped by turning off the power switch.

(Control procedure)

The control procedure of this embodiment is hereunder described in detail referring to FIG. 11 through FIG. 18.

In the following paragraphs, the term "on-edge" is defined as change in status, where the switch, sensor, signal or the like changes from the off status to the on status. In contrast, the term "off-edge" represents change in status, where the switch, sensor, signal or the like changes from the on status to the off status.

Figure 11:
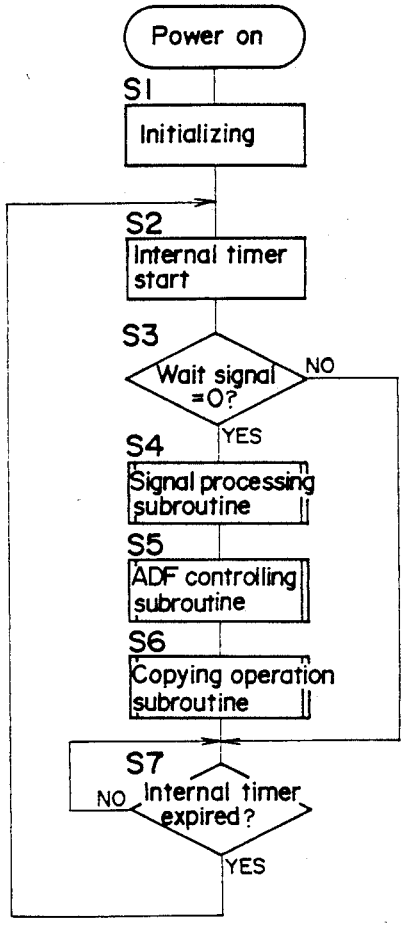
FIG. 11 is a flow chart showing a main routine of a first CPU.

FIG. 11 is a flow chart schematically showing the main routine carried out by the first CPU 1000.

When the power is turned on, the first CPU 1000 is reset, and the program is started. At step S1, a RAM and various registers built in the first CPU 1000 are cleared, and various movable elements are initialized. Next, the internal timer is started at step S2. The internal timer decides a required duration of the routine of the first CPU 1000.

At step S3, the CPU 1000 judges the status of a wait signal transferred from the second CPU 2000. If the level of wait signal is "1", the processing directly proceeds to step S7. If the level of wait signal is "0", the processing runs the signal processing subroutine at step S4, the ADF controlling subroutine at step S5, and the subroutine for controlling copying operation at step S6, and further proceeds to step S7. At step S7, the first CPU 1000 judges the completion of one cycle of the internal timer previously started at step S2. When it judges that one counting cycle of the internal timer has completed, the processing returns to step S2.

The signal processing subroutine at step S4 is hereunder described. Incidentally, since the ADF controlling subroutine at step S5 and the copying operation subroutine at step S6 are similar to the conventional ones, the detailed description of them is omitted in this embodiment.

Figure 12A:
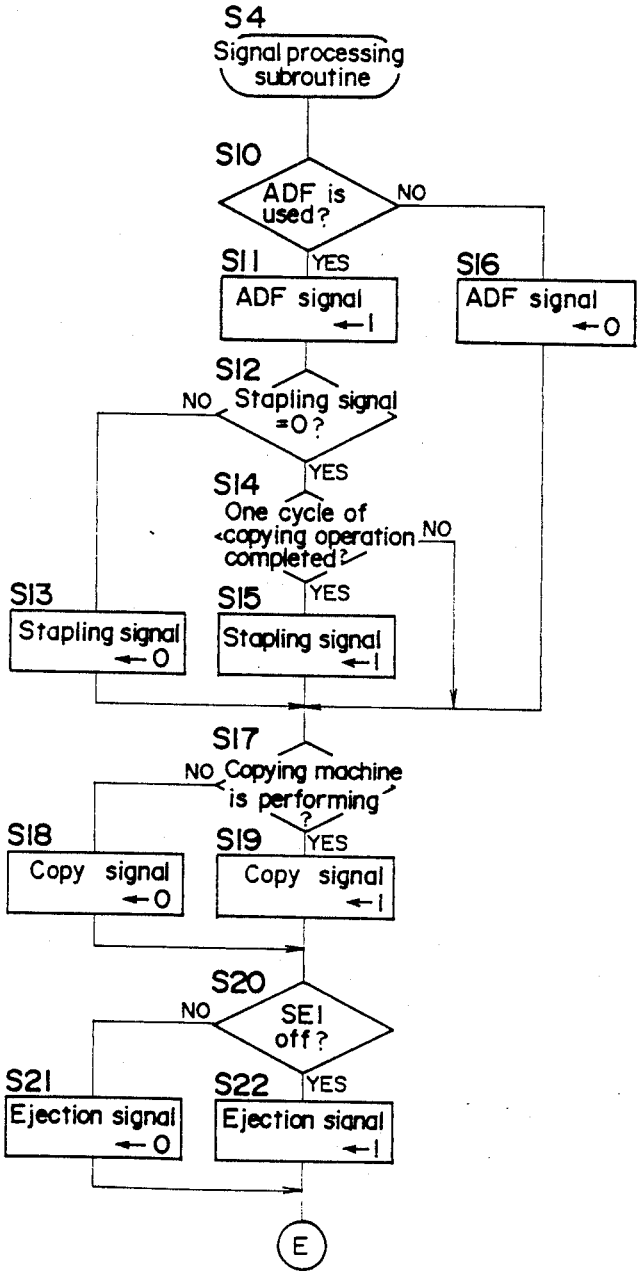
FIG. 12*a* and FIG. 12*b* are flow charts showing a subroutine for signal processing.
Figure 12B:
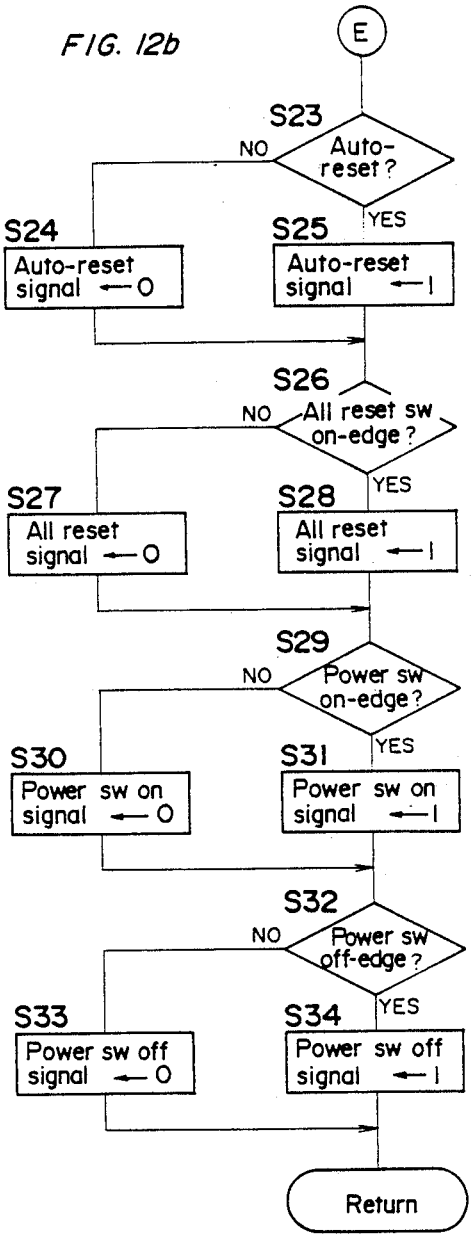

FIGS. 12*a* and 12*b* are flow charts showing the signal processing subroutine executed at step S4 of the main routine.

First, whether or not the ADF 30 is currently used is judged at step S10. If the ADF 30 is not used, an ADF signal is reset at the level of "0" at step S16, and then the processing proceeds to step S17. If the ADF 30 is currently used, the ADF signal is set at the level of "1" at step S11, and whether or not a stapling signal is at the level of "0" is judged at step S12. If the stapling signal has been set at the level of "1", the stapling signal is reset at the level of "0" at step S13, and the processing goes to step S17. If the stapling signal has been reset at the level of "0", whether or not one cycle of copying operation has been completed is judged at step S14. If one cycle of copying operation has not completed, the processing goes to step S17. If one cycle of copying operation has completed, the stapling signal is set at the level of "1" at step S15, and the processing goes to step S17. That is, when one cycle of copying operation using the ADF 30 is completed, the stapling signal is set at the level of "1", and thereby the stapling processing is executed.

At step S17, whether or not the copying machine 1 is performing the copying operation is judged. If the copying machine 1 is not performing the copying operation, a copy signal is reset at the level of "0" at step S18. If the copying machine 1 is performing the copying operation, the copy signal is set at the level of "1" at step S19. Next, at step S20, whether or not eh sensor SE1 is in the off status is judged. If the sensor SE1 is in the on status, an ejection signal is reset at the level of "0" at step S21. In contrast, if the sensor SE1 is in the off status, the ejection signal is set at the level of "1" at step S22.

Further, whether or not he automatic reset system is actuated is judged at step S23. If the automatic reset system is not actuated, an automatic reset signal is reset at the level of "0" at step S24. If the automatic reset system is actuated, the automatic reset signal is set at the level of "1". Next, at step S26, whether or not he all reset key 303 is on-edge is judged. If the all reset key 303 is on-edge, that is, the key 303 is pressed, an all reset signal is set at the level of "1" at step S28. If the key 303 is not on-edge, the all reset signal is set at the level of "0".

At step S29, whether or not the power switch is on-edge is judged. If the power switch is on-edge, a power-switch-on signal is set at the level of "1" at step S31. If the power switch is not on-edge, the power-switch-on signal is reset at the level of "0" at step S30. Next, at step S32, whether or not the power switch is off-edge is judged. If the power switch is off-edge, a power-switch-off signal is set at the level of "1". If the power switch is not off-edge, the power-switch-off signal is reset at the level of "0", and the processing returns to the main routine.

Figure 13:
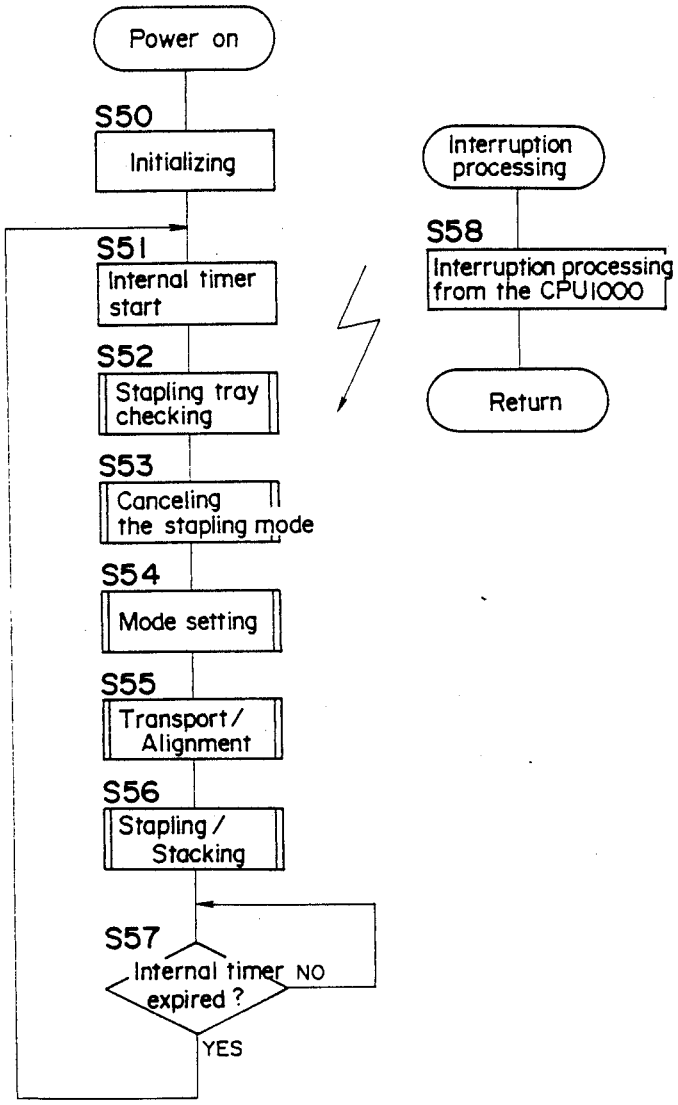
FIG. 13 is a flow chart showing a main routine of a second CPU.

FIG. 13 is a flow chart showing the main routine carried out by the second CPU 2000.

Once the second CPU 2000 is reset to start the program at step S50, first a RAM is cleared, and various registers and each unit are initialized. Next, the internal timer is started at step S51. The internal timer determines a duration required for one cycle of the main routine.

Then, the subroutines at steps S52 through S56 are called. When all the subroutines have been terminated, the second CPU 2000 at step S57 waits for the completion of counting cycle of the internal timer and returns to step S51. With various times used in various subroutines, the count of each timer is performed based on the duration of one cycle of the main routine.

Additionally, upon the interruption request from the first CPU 1000 on the copying machine 1, the second CPU 2000 executes the interruption processing at step S58.

Figure 14:
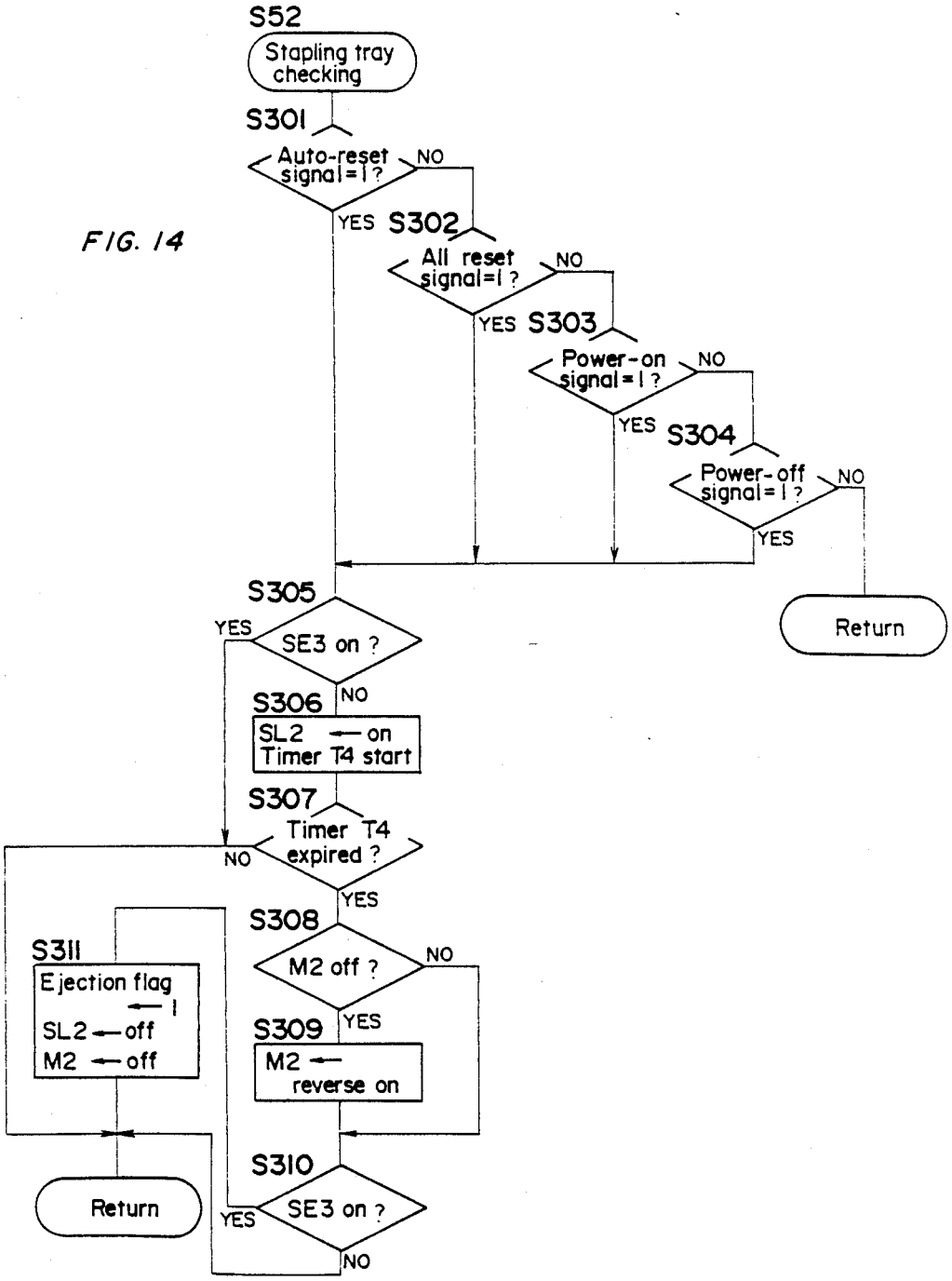
FIG. 14 is a flow chart showing a subroutine for checking in a stapling tray.

FIG. 14 is a flow chart showing a stapling tray checking subroutine which is executed at step S52 in the main routine of the CPU 2000.

First, whether an automatic reset signal outputted from the first CPU 1000 on the copying machine 1 is at the level of "1" or not is judged at step S301. If the automatic reset signal is not at "1", whether an all reset signal outputted from the first CPU 1000 on the copying machine 1 is at the level of "1" or not is judged at the next step S302. If the all reset signal is not at "1", whether a power-switch-on signal outputted from the first CPU 1000 on the copying machine 1 is at the level of "1" or not is judged at the next step S303. If the power-switch-on signal is not at "1", whether a power-switch-off signal outputted from the first CPU 1000 on the copying machine 1 is at the level of "1" or not is judged at the next step S304. If the power-switch-off signal is not at "1", the processing returns to the main routine.

On the other hand, if one of the signals at steps S301, S302, S303 and S304 is at "1", the processing instantly goes to step S305 to judge whether the sensor SE3 for detecting the presence or the absence of copying papers int he stapling tray 90 is turned on or not. If the sensor SE3 is turned on, that means the absence of copying papers, the processing returns to the main routine. If the sensor SE3 is turned off, that means the presence of copying papers, the solenoid SL2 is turned on to open the stopper 95, and the timer T4 is started. The timer T4 is to determine the timing to reverse the paddle wheel 120. Therefore, when it is confirmed at step S307 that the timer T4 has counted up the time, the motor M2 is turned off is confirmed at step S308, and the motor M2 is reversed at step S309 to rotate the paddle wheel 120 in the direction reverse to the arrow (c) in FIG. 1. Through the processing as described above, copying papers are ejected from the stapling tray 90. At step S310, whether the sensor SE3 is turned on or not is judged. If the sensor SE3 is turned on, that means the absence of copying papers in the stapling tray 90, the ejection flag is set at the level of "1" at step S311 to turn off the solenoid SL2 and the motor M2, and then the processing returns to the main routine.

The reason why the presence or the absence of copying papers is checked not only at the time of outputting of an automatic reset signal and an all reset signal but also at the time of outputting of a power-switch-off signal is that copying papers can be ejected from the stapling tray 90 by checking a power-switch-off signal even if the power switch is turned off before the operations of the automatic reset system and the all reset system. Also, when the copying machine 1 stops its operation owing to the failure of electric power supply or the like, copying papers in the stapling tray 90 can not be ejected. In such a case, the copying papers can be ejected from the stapling tray 90 by checking a power-switch-on signal when the power supply is recovered.

Figure 15:
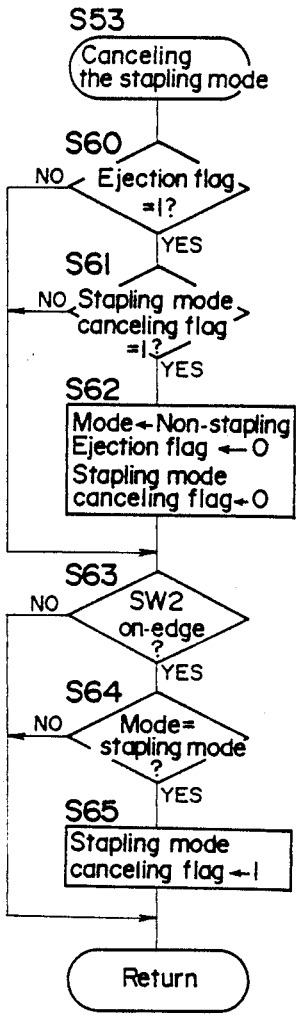
FIG. 15 is a flow chart showing a subroutine for canceling a stapling mode.

FIG. 15 is a flow chart showing the subroutine at step S53 for canceling the stapling mode.

First, whether or not the ejection flag is at the level of "1" is judged at step S60, and then whether or not a stapling mode canceling flag is at the level of "1" is judged at step S61. The ejection flag is set at the level of "1" when the stapled set of copying papers has been stored in the stack box 161, and it is reset at "0" when the copying papers prepared int he next cycle of copying operation have been stored in the stapling tray 90. Additionally, the stapling mode canceling flag is set at "1" when the canceling switch SW2 is turned on. If both the ejection flag and the stapling mode canceling flag are set at the level of "1", the non-stapling mode is designated as a current operation mode at step S62, and the ejection flag and the stapling mode canceling flag are reset at "0".

Next, whether or not the stapling status of the canceling switch SW2 is on-edge status is judged at step S63. When the switch SW2 is changed over to on-edge, whether or not the stapling mode has been designated as a current operation mode is judged at step S64. If the stapling mode has been designated, the stapling mode canceling flag is set at the level of "1" at step S65. More specifically, the canceling switch SW2 is arranged so as to accept canceling instruction even during the copying operation, that is, when the stapling mode canceling flag is set at "1", the operation mode is changed from the stapling mode to the non-stapling mode after copying papers for current one cycle of copying operation are stapled and then stored in the stack box 161 at steps S60 through S62.

Figure 16:
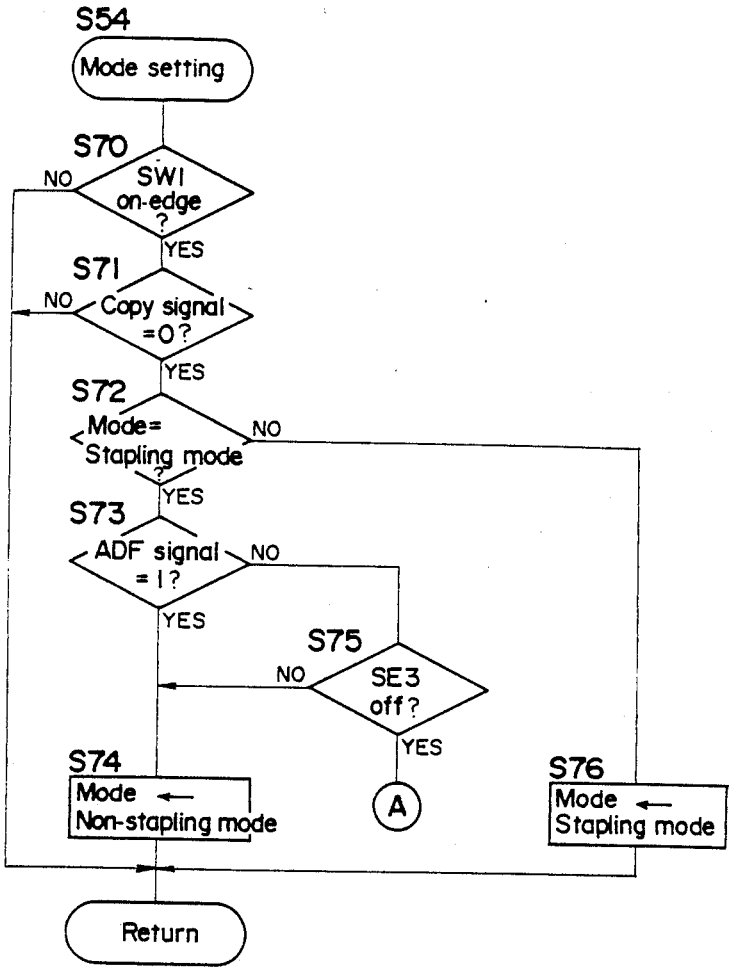
FIG. 16 is a flow chart showing a subroutine for mode setting.

FIG. 16 is a flow chart showing the mode setting subroutine executed at step S54 in the main routine of the CPU 2000.

In this subroutine, first, whether or not the mode select switch SW1 is on-edge status is judged at step S70. When the switch SW1 is on-edge, whether or not the copy signal has been reset at the level of "0" is judged at step S71. The level of the copy signal is maintained at "1" while the copying machine 1 is performing the copying operation. Accordingly, when it is judged that the level of the copy signal is "0", that is, the copying machine 1 is not performing the copying operation, whether or not the stapling mode has been designated as the current operation mode is judged at step S72. If the stapling mode has not been designated, the stapling mode is designated at step S76. If the stapling mode has been designated, whether or not the level of the ADF signal is "1", that is, whether or not the ADF 30 is currently used for the copying operation is judged at step S73. If the ADF 30 is used, the non-stapling mode is designated at step S74. If the ADF 30 is not currently used, whether or not the sensor SE3 for detecting copying papers in the stapling tray 90 is in the off status is judged at step S75. If the sensor SE3 has not been turned off, the non-stapling mode is similarly designated at step S74. If the sensor SE3 is put in the off status, the processing proceeds to step S514 in the transport/alignment subroutine shown in FIG. 17*b*. More specifically, when the copying operation and the stapling operation are performed without using the ADF 30, the stapling operation is forcibly commenced by pressing the switch SW1, since a signal for automatically executing the stapling operation (stapling signal) is not generated. Additionally, when the sensor SE3 is in the off status, the stapling operation is performed, since there are copying papers present in the stapling tray 90. However, when the sensor SE3 is in the on status, only the current operation mode is changed to the non-stapling mode not to execute the stapling operation since there are no copying papers in the stapling tray 90.

Figure 17A:
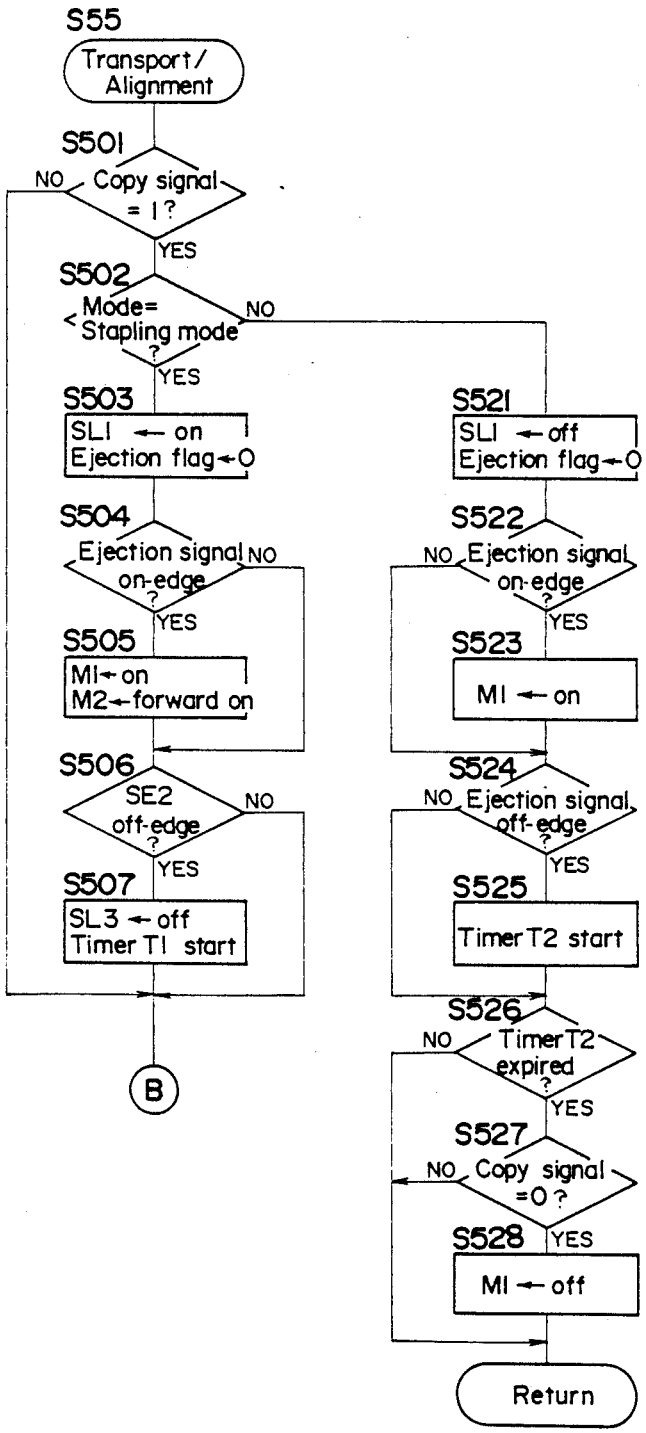
FIGS. 17*a* and 17*b* are flow charts showing a subroutine for paper transport/alignment.
Figure 17B:
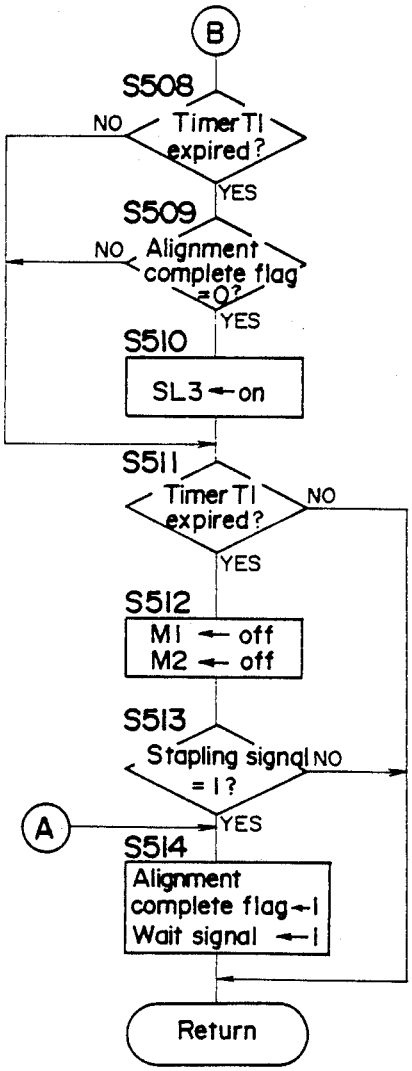

FIGS. 17*a* and 17*b* are flow charts showing the transport/alignment subroutine performed at step S55 in the main routine of the CPU 2000.

First, whether or not the level of the copy signal outputted from the first CPU 1000 has been "1" is judged at step S501, and whether or not the stapling mode has been designated as the current operation mode is judged at step S502. If the above two criteria are satisfied, the solenoid SL1 is turned on at step S503 to shift the diverting member 70 to the position indicated by the solid line in FIG. 1 and to reset the ejection flag at "0". When the copy signal is at "1", it means that the copying operation is in progress, and when the copy signal is at "0", it means that the copying operation has been finished. The term "copying operation" means a process of operation beginning at the time when the copy start key 301 is depressed and ending at the time when a cycle of copying operation is completed and copying papers are discharged into the tray 80 or the stack box 161.

Next, after it is judged at step S504 that the sensor SE1 located in the ejection area of the copying machine 1 is on-edge, at step S505 the motor M1 is turned on, and the motor M2 is also turned on to rotate in the forward direction, and thereby the rollers 60, 85 and 100 are driven, and the paddle wheel 120 is actuated to rotate in the direction of the arrow (c).

Next, after it is judged at step S506 that the signaling status of the sensor SE2 disposed on the stapling passage is off-edge, at step S507 the SL3 is turned off and a timer T1 is started. Turning off the solenoid SL3 retreats the head 110*a* of the pressing member 110 from the stapling tray 90. Then, once the completion of one counting cycle of the timer T1 is confirmed at step s508, whether or not the alignment complete flag is at the level of "0" is judged at step S509. If the above two criteria are satisfied, at step S510 the solenoid SL3 is turned off to insert the head 110*a* of the pressing member 110 into the stapling tray 90, and the head 110*a* presses the upper portion of the stored copying papers.

Also, after the completion of one counting cycle of the timer T1 is confirmed at step S511, at step S512 the motors M1 and M2 are turned off. Whether or not the level of the stapling signal is "1" is judged at step S513. If the level of the stapling signal is "1", at step S514 the level of the alignment complete flag is set "1" to initiate the stapling operation, and the level of the wait signal is set "1" in order to inhibit the operation of the copying machine 1. When the ADF 30 is not used, the processing returns to the main routine and proceeds to the next subroutine S56 since it is not definable whether the stapling processing is necessary or not.

Additionally, if the criteria at previous step S502 are unsatisfactory and the non-stapling mode is executed, at step S521 first the solenoid SL1 is turned off and the diverting member 70 keeps in the position indicated by the dashed line in FIG. 1. At this time, the ejection signal is reset at "0". Then, after it is confirmed at step S522 that the status of the ejection signal is on-edge, the motor M1 is turned off in order to drive the rollers 60 and 85.

Next, once the status of the ejection signal is off-edge is confirmed at step S542, a timer T2 starts at step S525. A specified time needed for a copying paper to reach the ejection tray 80 and to be completely ejected after the sensor SE1 detects the copying paper is incorporated into the timer T2. After the timer T2 counts up the time at step S526, at the next step S527 when the level of the copy signal is "0", the motor M1 is turned off at step S528, and the processing of this subroutine is terminated.

Figure 18:
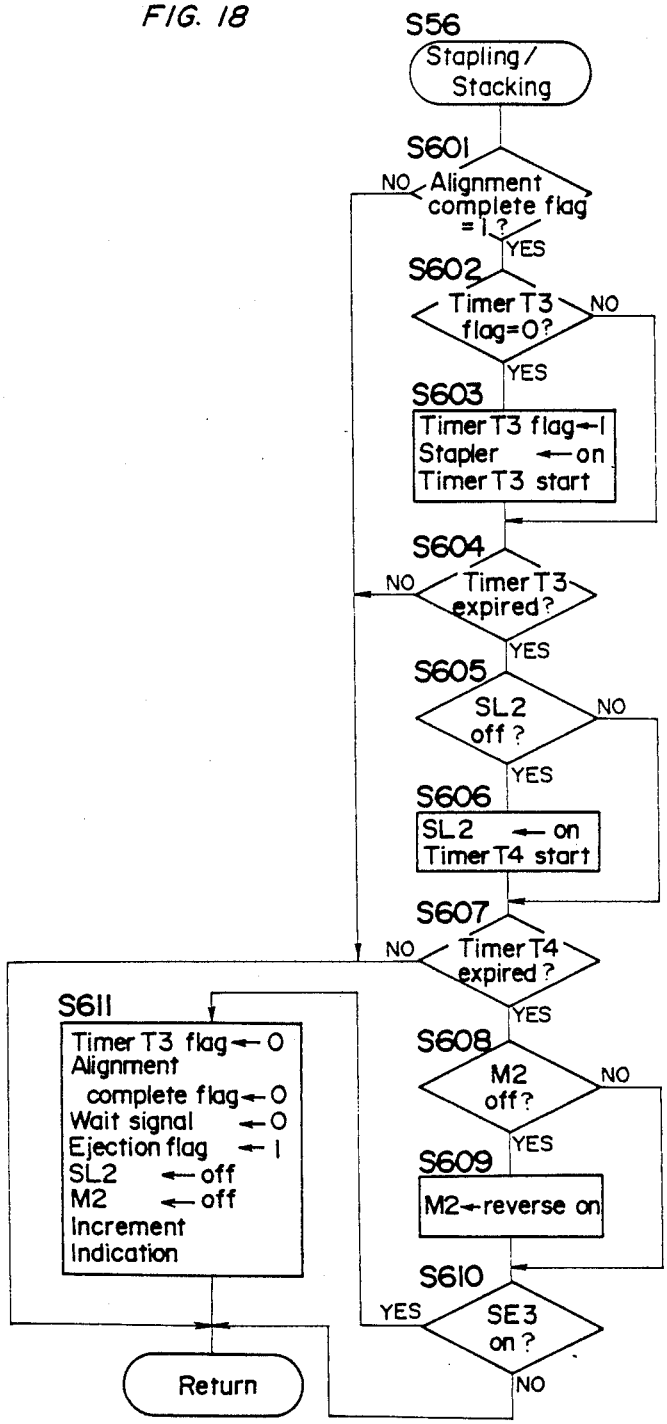
FIG. 18 is a flow chart showing a subroutine for paper stapling/stacking.

FIG. 18 is a flow chart showing the stapling/stacking subroutine executed at step S56 in the main routine of the CPU 2000.

First, at step S601, whether or not the level of the alignment complete flag is set at "1" is judged. Then, at step S602, whether or not the level of the timer T3 flag is reset at "0" is judged. If both the criteria are satisfied, which means that alignment of copying papers stored in the stapling tray 90 has been completed, at step S603 the level of the timer T3 flag is set "1", and the stapler 130 is turned on in order to staple the copying papers. Additionally, the stapler start signal is turned off instantaneously. At the same time, the timer T3 is started. The timer T3 serves to synchronize the timing to open up the stopper 95. Once the completion of counting cycle of the timer T3 is confirmed at step S604, whether or not the solenoid SL2 has been turned off is judged at step S605. If the solenoid SL2 is at the off status, at step S606 the solenoid SL2 is turned on to open up the stopper 95, and a timer T4 is started, which allows the stapled copying papers to fall freely. The timer T4 is provided to synchronize the timing to reverse the paddle wheel 120. When the completion of one counting cycle of the timer T4 is detected at step 607, it is detected at step S608 that the motor M2 is in the off status, and the motor M2 is actuated in the reverse direction at step S609 so as to turn the paddle wheel 120 in the direction reverse to the arrow (c). This arrangement allows copying papers to fall while turning to the right direction in FIG. 2, thereby the stapled set of the copying papers is ejected from the stapling tray 90 while the stapled portion does not interfere with the stapling position (D).

Next, whether or not the sensor SE3 which detects the copying papers stored in the stapling tray 90 is in the on status is judged at step S610. If the sensor SE3 is in the on status, that is, if it has been detected that a set of the copying papers is ejected from the stapling tray 90, at step S611 the timer T3 flag, the alignment complete flag and the wait signal are reset respectively at the level of "0", and the ejection flag is set at the level of "1", and simultaneously, the solenoid SL2 and the motor M2 are turned off, and then the second CPU 2000 increments the number of stacked sets of the display 172, and indicates the number with a display 172.

(Stapling mode)

When a stapling process is needed, in the present embodiment, an operator can select an automatic stapling mode or a manual stapling mode.

(Automatic stapling mode)

The automatic stapling mode is selected when an operator executes a stapling process using the ADF 30, and therein original documents fed by the ADF 30 are copied onto copying papers to make a specified number of copy sets, and the copy sets are automatically stapled and ejected to the stack unit 160. The processing of the operation in the automatic stapling mode is explained roughly below. First, at step S11 shown in FIG. 12*a*, an ADF signal is set at "1" since the ADF 30 is used, and then after the completion of one cycle of the copying operation, a stapling signal is set at "1" at step S15. Next, at step S514 in the paper transport/alignment subroutine shown in FIG. 17*b*, the alignment completion flag is set at "1", and thereby at step S603 in the stapling/stacking subroutine shown in FIG. 18, a copy set is stapled, and then the stopper 95 is opened up at step S606. In the automatic stapling mode, the above processing is automatically repeated a specified times according to the necessary number of copy sets.

(Manual stapling mode)

The manual stapling mode is selected when an operator executes an copying operation without using the ADF 30 and the copy sets are needed to be stapled. First, the operator should select the stapling mode with the select switch SW1 and make copy sets to be stapled. When the key of the select switch SW1 is pressed again by the operator, the operations of stapling the copy sets and ejecting them from the stapling tray 90 are executed. The processing in this case is explained below with reference to the flow charts. First, at step S16 shown in FIG. 12*a*, an ADF signal is reset at "0" since the ADF 30 is not used. When the key of the select switch SW1 is pressed to proceed to the stapling operation after the completion of the copying operation, the judgment at step S70 shown in FIG. 16 is "YES", and the processing proceeds to steps S71, S72 and S73 in order. As it is judged at step S73 that the ADF signal is at "0", the processing goes to step S75. At step S75, the sensor SE3 is turned off since there are sheets in the stapling tray 90, and the processing goes to step S514 shown in FIG. 17*b*, where the alignment complete flag is set at "1". Thereby, the stapling operation is executed at step S603 in the stapling/stacking subroutine shown in FIG. 18, and then the stopper 95 for paper ejection is opened up. Thus, the manual stapling operation is completed.

[Second embodiment]

Figure 19:
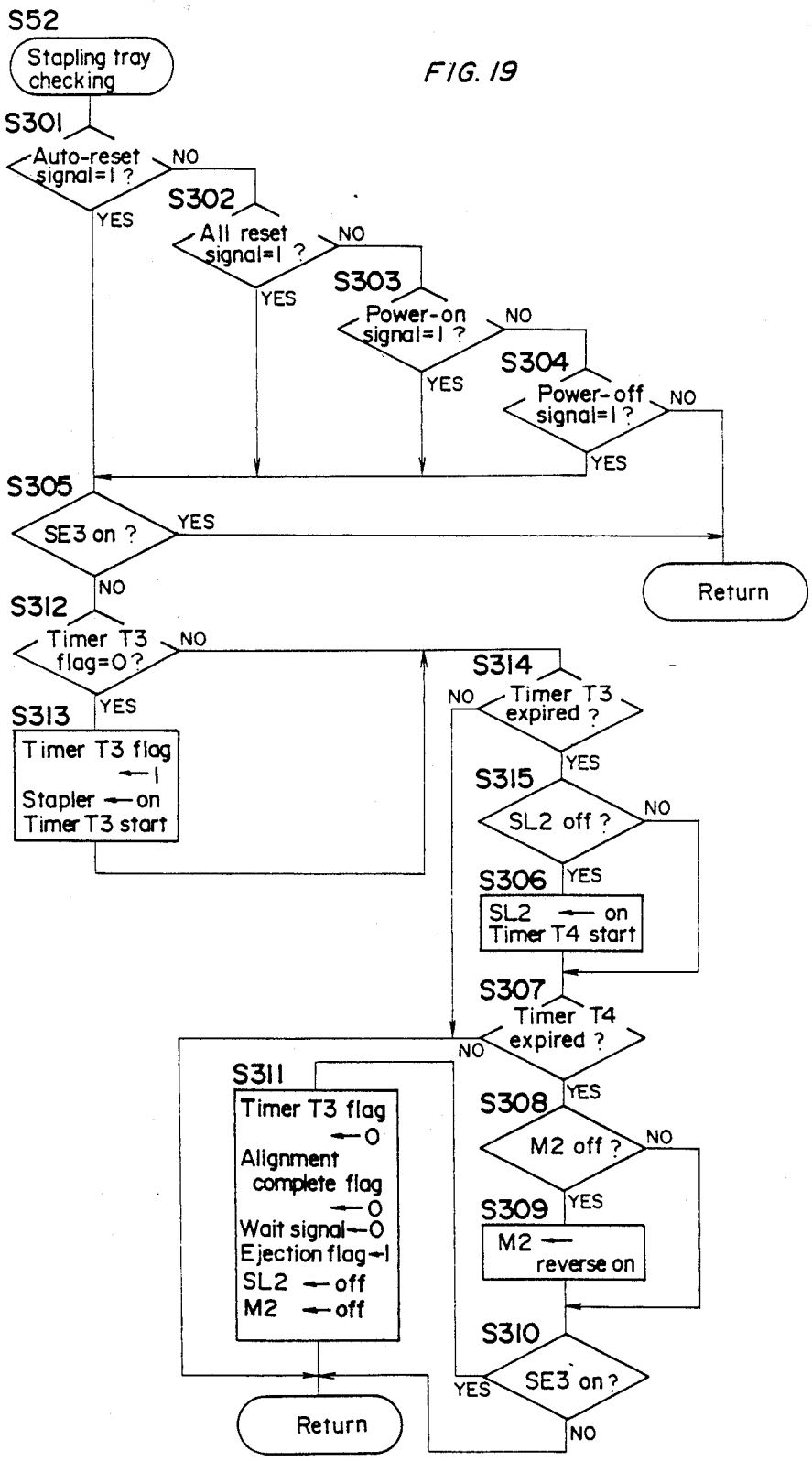
FIG. 19 is a flow chart showing a subroutine for checking in the stapling tray in the other embodiment of the present invention.

In the above described first embodiment, when the sheets left in the stapling tray 90 are ejected by the automatic reset system or the all reset system during the operation in the manual stapling mode, as shown in FIG. 14, the sheets are ejected without being stapled. However, when the sheets in the stapling tray 90 are ejected without being bound the sheets may be out of order. Therefore, in this second embodiment, even in the case that the automatic reset system or the all reset system is actuated, the sheets can be stapled before they are ejected. In this control system, a subroutine shown in FIG. 19 is used instead of the stapling tray checking subroutine shown in FIG. 14. In the subroutine shown in FIG. 19, the steps on and after step S306 in the subroutine shown in FIG. 14 are replaced with the steps on and after step S606 in the stapling /stacking subroutine shown in FIG. 18. However, the operations of counting up and indicating the count at the step S611 are cut out since they are the operations for the automatic stapling mode. That is, when the subroutine shown in FIG. 19 is applied, in the case that an automatic reset signal, an all reset signal, a power-switch-on signal or a power-switch-off signal is detected, the sheets in the stapling tray 90 are ejected to the stack unit 160 with being stapled, the same as the operation in the automatic stapling operation mode.

Although the present invention has been described in connection with the preferred embodiments thereof, it is to be noted that various changes and modifications are apparent to those skilled in the art. Such changes and modifications are to be understood as included within the scope of the present invention as defined by the appended claims, unless they depart therefrom.

What is claimed is:

1. A copying apparatus, comprising:
a copying machine for forming images on papers and for ejecting the papers therefrom;
automatic reset means for resetting a copying mode to an initial mode when said copying machine has not operated for a specified time since the completion of a copying operation;
a paper handling device for storing and aligning a predetermined number of papers ejected from said copying machine, for stapling the papers and for ejecting the bound papers therefrom;
means for detecting the presence or the absence of papers in said copying paper handling device; and
control means for controlling said paper handling device to eject the papers therefrom when the copying mode is reset to the initial mode by said automatic reset means and said paper detecting means detect the presence of papers in said paper handling device.

2. A copying apparatus as claimed in claim 1, wherein said control means further control said paper handling device to staple the papers therein before to eject the papers therefrom when said automatic reset means are actuated.

3. A copying apparatus, comprising:
a copying machine for forming images on papers and for ejecting the papers therefrom;
all reset means for resetting a copying mode to an initial mode by pressing a specified key;
a paper handling device for storing and aligning a predetermined number of papers ejected from said copying machine, for stapling the papers and for ejecting the bound papers therefrom;
means for detecting the presence or the absence of papers in said paper handling device; and
control means for controlling said paper handling device to eject the papers therefrom when the copying mode of said copying machine is reset to the initial mode by said all reset means and said paper detecting means detect the presence of papers in said paper handling device.

4. A copying apparatus as claimed in claim 3, wherein said control means further control said paper handling device to staple the papers therein before to eject the papers therefrom when said all reset means are actuated.

5. A copying apparatus, comprising:
a copying machine for forming images on papers and for ejecting the papers therefrom;
a paper handling device for storing and aligning a predetermined number of papers ejected from said copying machine, for stapling the papers and for ejecting the bound papers therefrom;
means for detecting the presence or the absence of papers in said paper handling device; and
control means for controlling said paper handling device to eject the papers therefrom when a power switch is operated and said detecting means detect the presence of papers in said paper handling device.

6. A copying apparatus as claimed in claim 5, wherein said control means further control said paper handling device to staple the papers therein before to eject the papers therefrom when said power switch is operated.

* * * * *